US010265971B2

(12) United States Patent
Häcker

(10) Patent No.: US 10,265,971 B2
(45) Date of Patent: Apr. 23, 2019

(54) PRINTING MACHINE HAVING AT LEAST ONE PRINTING ASSEMBLY AND AT LEAST ONE DRYER UNIT AND A METHOD FOR OPERATING A PRINTING MACHINE

(71) Applicant: KOENIG & BAUER AG, Würzburg (DE)

(72) Inventor: Christoph Häcker, Karlstadt (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/534,149

(22) PCT Filed: Mar. 22, 2016

(86) PCT No.: PCT/EP2016/056184
§ 371 (c)(1),
(2) Date: Jun. 8, 2017

(87) PCT Pub. No.: WO2016/169710
PCT Pub. Date: Oct. 27, 2016

(65) Prior Publication Data

US 2018/0229511 A1 Aug. 16, 2018

(30) Foreign Application Priority Data

Apr. 23, 2015 (DE) ..... 10 2015 207 450

(51) Int. Cl.
*B41J 11/00* (2006.01)
*B41J 15/04* (2006.01)
(Continued)

(52) U.S. Cl.
CPC ..... *B41J 11/002* (2013.01); *B41J 2/145* (2013.01); *B41J 15/04* (2013.01); *B41J 15/046* (2013.01); *B41M 7/009* (2013.01)

(58) Field of Classification Search
None
See application file for complete search history.

(56) References Cited

U.S. PATENT DOCUMENTS 8,322,047 B2 12/2012 Soltysiak et al.
8,376,497 B2 2/2013 Chappell
(Continued)

FOREIGN PATENT DOCUMENTS

CA 2281212 A1 3/2000
DE 19903607 A1 8/2000
(Continued)

OTHER PUBLICATIONS

International Search Report PCT/EP2016/056184 dated Jul. 28, 2016.

*Primary Examiner* — Erica S Lin
(74) *Attorney, Agent, or Firm* — Mattingly & Malur, PC

(57) ABSTRACT

A printing machine includes a printing assembly and a dryer unit having a dryer, with the dryer having at least one first energy output device. The at least one first energy output device is arranged such that it can be moved over an actuating distance between at least one active position and at least one stop position. The actuating distance extends in a continuously linear manner in or opposite to an actuating direction over at least 75% of its entire length. The actuating direction deviates by a maximum of 40° from at least one horizontal direction. The actuating direction deviates by a maximum of 40° from a normal direction of an average surface normal of an entire section, located in an active region of the at least one first energy device, of a transport path which is provided for a web-type printing machine. A method of operating a printing machine is also disclosed.

15 Claims, 12 Drawing Sheets

(51) Int. Cl.
*B41J 2/145* (2006.01)
*B41M 7/00* (2006.01)

(56) References Cited

U.S. PATENT DOCUMENTS

| | | | | |
|---|---|---|---|---|
| 8,944,583 | B2 | 2/2015 | Waschnig | |
| 2005/0068396 | A1* | 3/2005 | Ferran | B41J 3/543 347/102 |
| 2009/0013553 | A1 | 1/2009 | Soltysiak et al. | |
| 2012/0162299 | A1 | 6/2012 | Chappell | |
| 2014/0104360 | A1* | 4/2014 | Hacker | B41J 3/60 347/104 |
| 2016/0075154 | A1 | 3/2016 | Häcker et al. | |

FOREIGN PATENT DOCUMENTS

| | | | |
|---|---|---|---|
| DE | 102011076899 | A1 | 12/2012 |
| DE | 102013208754 | A1 | 11/2014 |
| EP | 1445563 | A2 | 8/2004 |
| EP | 2047992 | A2 | 4/2009 |
| GB | 2349848 | A | 11/2000 |
| WO | 2013056292 | A1 | 4/2013 |

* cited by examiner

300

318
317
302
344
⊗A
S, N
346
318
351
347
343
303
348
306

300

344
318
302
301
317
⊗A
S, N
346
318
351
347
348
343
303
306

PRINTING MACHINE HAVING AT LEAST ONE PRINTING ASSEMBLY AND AT LEAST ONE DRYER UNIT AND A METHOD FOR OPERATING A PRINTING MACHINE

CROSS-REFERENCE TO RELATED APPLICATIONS

This application is the U.S. National Phase, under 35 U.S.C. § 371, of PCT/EP2016/056184, filed Mar. 22, 2016; published as WO 2016/169710A1 on Oct. 27, 2016 and claiming priority to DE 10 2015 207 450.1, filed Apr. 23, 2015, the disclosures of which are expressly incorporated herein by reference.

FIELD OF THE INVENTION

The invention relates to a printing machine having at least one printing assembly and at least one dryer unit, and to a method for operating a printing machine. In the printing machine having the at least one printing assembly and the at least one dryer unit, at least one printing assembly has at least one ink jet print head. The at least one dryer unit has at least one first dryer. The at least one first dryer has at least one first energy output device, which at least one first energy output device is arranged to move along a positioning path between at least one active position and at least one deactivated position. The positioning path extends in a continuously linear fashion in or opposite a positioning direction over at least 75% of its total length. The positioning direction deviates no more than 40° from at least one horizontal direction.

BACKGROUND OF THE INVENTION

Various printing methods are used in printing machines. Non-impact printing (NIP) methods are understood as printing methods that do not require a fixed, that is, a physically unchanging printing forme. Such printing methods can produce different printed images in each printing procedure. Examples of non-impact printing methods include ionographic methods, magnetographic methods, thermographic methods, electrophotography, laser printing, and, in particular, inkjet printing methods. Such printing methods typically have at least at least one image producing device, for example at least one print head. In the case of the inkjet printing method, such a print head is configured, for example, as an inkjet print head and has at least one and preferably a plurality of nozzles, by means of which at least one printing fluid, for example in the form of ink droplets, can be transferred selectively to a printing substrate. In this process, it is important for the distance between the printing substrate and the image producing device to be kept as constant as possible, to allow image production to be synchronized over time, while at the same time avoiding damage to the image producing device.

In the inkjet printing method, for example, particularly when water-based inks are used, the printing substrate can become deformed, for example, forming ripples. Such ripples can entail the risk of damage both to print heads and to the printing substrate, and can also lead to low print quality, for example due to the different flight time lengths for droplets of printing fluid.

US 2012/0162299 A1 discloses a printing assembly that has a plurality of print heads and stationary guide elements in the region of the print heads.

Printing substrate that has been provided with a printing fluid is typically dried in a subsequent process procedure. Various apparatuses for enabling such a drying process are known. For example, an energy output device that is capable of removing solvents and/or initiating crosslinking reactions may be provided. It is known to move the energy output device in question from an active position to a different, deactivated position, for example for maintenance purposes.

US 2009/0013553 A1 discloses a printing machine having at least one dryer unit. The dryer unit has a dryer that can be moved, parallel to a plane that is occupied by the printing substrate within the dryer, into a maintenance position.

CA 2281212 A1 discloses a printing machine having a dryer, which is equipped with hot air nozzles and can be pivoted about a pivot axis to allow maintenance work to be performed on a printing unit.

EP 1445563 A2 discloses a dryer that can be raised to allow a web to be threaded in, and can also be displaced horizontally to allow maintenance work to be performed on the rollers beneath the dryer.

DE 10 2013 208754 A1 discloses a printing machine having a dryer, and describes a threading means in the region of a printing unit.

EP 2047992 A2 discloses a printing machine having a dryer.

DE 199 03 607 A1 discloses a flexographic printing machine with radially displaceable dryer units.

WO 2013/056292 A1 discloses a printing machine having a dryer, which can be moved together with a print head, and the spacing of which from one another cam be adjusted.

DE 10 2011 076899 A1 discloses a printing machine having an inkjet print head, a radiation dryer and a cooling roller.

SUMMARY OF THE INVENTION

The object of the present invention is to devise a printing machine having at least one printing assembly and at least one dryer unit, and to devise a method for operating a printing machine.

The object is achieved according to the present invention by the provision of the positioning direction which deviates no more than 40° from a normal direction of a mean surface normal of an entire section of a transport path provided for web-type printing substrate, that entire section lying in an active zone of the at least one first energy output device. The normal direction of the mean surface normal is determined as a mean value over all of the directions of surface normals of tangential planes on all surface elements of the transport path provided for the printing substrate that lie in the active zone of the at least one first energy output device. At least two guide elements of the printing assembly define a transport path provided for the printing substrate through the printing assembly. When the guide elements are in their working position, a main conveying direction of the at least one printing assembly, which is situated upstream of the at least one dryer unit, is defined by a rectilinear connection between a first guide element, with respect to a printing section of the transport path provided for printing substrate in the at least one printing assembly situated upstream of the at least one dryer unit, and a last guide element, with respect to the printing section of the transport path provided for printing substrate in the at least one printing assembly situated upstream of the at least one dryer unit. That main conveying direction has a component that points upward.

A method is provided for operating a printing machine having at least one first printing assembly and at least one dryer unit, with the at least one dryer unit having at least one first dryer with at least one first energy output device. In a first deactivation process, the at least one first energy output device is moved at least 5 mm along a positioning path in a positioning direction from an active position to a threading position and is halted there. The positioning path extend in a continuously linear fashion in or opposite the positioning direction over at least 75% of its total length. In a subsequent threading process, at least one web-type printing substrate is threaded in by at least one threading assembly along a transport path provided for the printing substrate to an active zone of the at least one energy output device. In a second deactivation process, the at least one first energy output device is moved at least 450 mm in the positioning direction along the positioning path, which extends in a continuously linear fashion in or opposite the positioning direction over at least 75% of its total length, from the active position to an access position that is different from the threading position, and is halted there. In a subsequent first maintenance process, at least one maintenance task is performed on the at least one first energy output device.

A printing machine has at least one printing assembly and at least one dryer unit. The at least one dryer unit has at least one first dryer, which is preferably embodied as at least one radiation dryer. The at least one first dryer has at least one first, preferably controllable and/or adjustable energy output device. The at least one first energy output device is embodied, for example, as at least one radiation source and/or at least one air supply line. The at least one radiation source is embodied, for example, as an infrared radiation source and/or as a radiation source for ultraviolet light and/or as a radiation source for electromagnetic radiation in the visible range and/or as a radiation source for microwave radiation. The at least one radiation source is preferably at least one controllable and/or adjustable radiation source. The at least one first energy output device is preferably embodied for the targeted transmission of energy, in particular from the at least one first energy output device to a printing substrate that is and/or can be located in an active zone of the first energy output device and is preferably at least partially furnished with printing fluid. The at least one first energy output device is arranged so as to move, in particular relative to a transport path provided for transporting web-type printing substrate. The active zone of the at least one first energy output device preferably intersects a transport path provided for transporting web-type printing substrate. The at least one dryer is preferably embodied as a radiation dryer.

The at least one first energy output device is arranged so as to move along a positioning path between at least one active position and at least one deactivated position, and more preferably two deactivated positions that are different particularly with respect to a positioning direction. The positioning path extends in a continuously linear fashion in and/or opposite a positioning direction over at least 75% of its total length, preferably over at least 90% of its total length, and more preferably over its entire total length. The total length is the maximum length the positioning path may have between two points. In other words, the at least one first energy output device is arranged so as to move along a positioning path that is at least 75% linear, preferably at least 90% linear, and more preferably completely linear, in and/or opposite a positioning direction between at least one active position and at least one deactivated position and more preferably two different deactivated positions. This means, in particular, that over its entire length, the positioning path extends in a continuously linear fashion and without any interposed deviation over at least 75%, more preferably at least 90%, and even more preferably 100% of said total length, and simultaneously in and opposite the positioning direction. Only at the beginning and/or at the end of the positioning path are deviations from said positioning direction conceivable.

The positioning direction preferably deviates from at least one horizontal direction by no more than 40°, more preferably no more than 30°, even more preferably no more than 15° and more preferably still, no more than 5°. The positioning direction further deviates by preferably no more than 40°, more preferably no more than 30°, even more preferably no more than 15° and more preferably still, no more than 5° from a normal direction, said normal direction being a normal direction of a mean surface normal of an entire section of a transport path provided for web-type printing substrate, which section lies, in particular, in an entire active zone of the at least one first energy output device. The normal direction of the mean surface normal is preferably determined as a mean value over all directions of surface normals of tangential planes to all surface elements of the transport path, which is provided for the printing substrate, that lie in the active zone of the at least one first energy output device. The positioning path is, in particular, the path along which an at least one geometric center of the movable component, in particular the first dryer 301, is and/or can be moved. For example, the positioning path is the path along which and/or parallel to which the at least one energy output device 302 is and/or can be moved.

One advantage is that this enables a space to be created by appropriately deactivating the energy output device, in particular moving it away from the transport path provided for the printing substrate, allowing an operator to reach and/or to enter said space to perform maintenance work on the at least one energy output device, for example, and/or to obtain access to a section of the transport path for the printing substrate located within the active zone. In the case of wide printing substrate webs, in particular, it is advantageous that the positioning direction makes the necessary positioning path independent of the width of the printing substrate web. A further advantage is that, even with a very short positioning path, a deactivation in the positioning direction enables a printing substrate web to be threaded in through the at least one first dryer. This allows a threading operation to be accelerated, in particular, because less time is required than if it were necessary to move the at least one energy output device to a relatively remote position in each case. One advantage of a substantially horizontal positioning direction is that, even with a relatively short positioning path, adequate space is available for an operator standing upright, in particular regardless of the width of the printing substrate.

The printing machine is preferably characterized in that at least one and preferably precisely one preferably continuous threading means, which is movable along at least one threading path, is and/or can be arranged, at least intermittently and preferably permanently, at least within the at least one dryer unit, and more preferably also within the at least one printing assembly, for threading in a printing substrate web. An arrangement within the dryer unit is understood in particular to mean that a projection of the at least one threading means intersects an active zone of the at least one energy output device, in or opposite an axial direction or transverse direction. The axial direction or transverse direction preferably extends parallel to a rotational axis of at least one printing substrate guide element of the printing machine and in particular of the dryer unit.

The printing machine is preferably characterized in that at least parts of the at least one threading path and more preferably the entire threading path are spaced by a distance of at least 2 cm with respect to the axial direction or transverse direction from each target region of each nozzle of each print head of said at least one printing assembly. Preferably, at least parts of the at least one threading path and preferably the entire threading path are spaced by a distance of at least 2 cm, more preferably at least 4 cm, even more preferably at least 6 cm and more preferably still, at least 8 cm with respect to the axial direction from each target region of each nozzle of each print head of said at least one printing assembly. Preferably, at least parts of the threading means and more preferably the entire threading means are spaced by a distance of at least 2 cm, more preferably at least 4 cm, even more preferably at least 6 cm and more preferably still, at least 8 cm with respect to the axial direction from each target region of each nozzle of each print head of said at least one printing assembly. This results in the advantage, particularly when combined with the possible positioning movement of the at least one energy output device of the at least one first dryer, that a printing substrate web can be threaded into the printing machine particularly easily and quickly and precisely, with no risk of damage to and/or soiling of nozzles of print heads and/or of components of the dryer unit.

The printing machine is preferably characterized in that at least one printing substrate web is and/or can be connected to the at least one threading means via at least one connecting element, the at least one connecting element further preferably being embodied as at least one threading tip. The printing machine is preferably characterized in that the at least one threading means is embodied as at least one continuous threading belt and/or in that at least one threading guide element is provided, by means of which the at least one threading path of the at least one threading means can be and/or is defined, the at least one threading guide element further preferably being embodied as at least one deflecting roller or as at least one chain guide and/or the at least one threading guide element being embodied as at least one rotatable threading guide element.

The at least one threading means for threading-in a printing substrate web along the provided transport path of the printing substrate web is preferably arranged in particular permanently along its at least one threading path within the printing machine. Preferably, the at least one threading means has at least two and more preferably at least five designated connecting points, at which at least one printing substrate web can be connected, directly and/or via at least one connecting element, to the at least one threading means. The printing machine is preferably characterized in that the at least two connecting points are spaced from one another in the axial direction by no more than 10 cm, more preferably no more than 5 cm, even more preferably no more than 2 cm and more preferably still, are not spaced from one another at all, and/or in that the at least two connecting points are spaced from one another along the at least one threading path.

Before the printing substrate web is threaded-in through the at least one printing assembly, at least one print head, embodied as an inkjet print head, of the at least one printing assembly, is preferably set aside from the provided transport path of the at least one printing substrate. Subsequently, in a sub-process of a threading process, at least one threading means is preferably moved along a threading path through the at least one printing assembly, thereby drawing the at least one printing substrate web along the transport path provided for the at least one printing substrate web. The threading path and the transport path are preferably spaced from one another as viewed in an axial direction.

Preferably, the printing machine is alternatively or additionally characterized in that at least two deactivated positions of the at least one first energy output device are provided, which are different particularly with respect to the positioning direction, and in which the at least one first energy output device can be selectively located depending on the operating mode. The at least two provided deactivated positions are preferably provided in addition to the at least one active position. One of the deactivated positions is a threading position, for example, and/or one of the deactivated positions is an access position. The shortest distance between the at least one first energy output device and the transport path provided for the printing substrate is greater when the first energy output device is located in the access position than when the first energy output device is located in the threading position, for example. More particularly, the shortest distance between the at least one first energy output device and the transport path provided for the printing substrate when the first energy output device is located in the threading position is greater, preferably by at least 5 mm, more preferably by at least 50 mm and even more preferably by at least 90 mm, and independently thereof by no more than 400 mm, for example, than when the first energy output device is located in the active position. Preferably, the shortest distance between the at least one first energy output device and the transport path provided for the printing substrate when the first energy output device is located in the access position is preferably greater, preferably by at least 450 mm, more preferably by at least 600 mm and even more preferably by at least 700 mm than when the first energy output device is located in the active position.

Preferably, the printing machine is alternatively or additionally characterized in that the at least one printing assembly has at least two image producing devices, embodied in particular as print heads. Preferably, the printing machine is alternatively or additionally characterized in that the at least one printing assembly has at least one inkjet print head and more preferably at least two inkjet print heads.

Preferably, the printing machine is alternatively or additionally characterized by the fact that a main conveying direction of the at least one printing assembly that is situated upstream of the at least one dryer unit, which conveying direction is defined by a rectilinear connection between a first guide element with respect to a printing section of the transport path provided for printing substrate, said guide element being part of the at least one printing assembly situated upstream of the at least one dryer unit, and a last guide element with respect to the printing section of the transport path provided for printing substrate, said guide element being part of the at least one printing assembly situated upstream of the at least one dryer unit, has an upward pointing component when the guide elements of said at least one printing assembly are arranged in their working position. For example, the printing machine is alternatively or additionally characterized by the fact that the provided transport path from the beginning of the printing section in the at least one printing assembly up to the end of the active zone of the at least one first energy output device, apart from any straight sections, is curved in only one direction, in particular convex with respect to the side of the printing substrate that has been imprinted in the at least one printing assembly. One advantage that results is that, following an ascending portion of the transport path for the printing substrate through the at least one printing assembly, a transport path that travels substantially downward through the at least one dryer is enabled, in which a freshly imprinted side of the printing substrate does not need to come in contact with any components of the printing machine between printing assembly and dryer. Preferably, the printing machine is alternatively or additionally characterized in that in the active zone of the at least one energy output device, a transport direction provided for the web-type printing substrate has a downward-pointing vertical component.

Preferably, the printing machine is alternatively or additionally characterized in that the at least one printing assembly has at least two inkjet print heads, each of which defines application positions for printing fluid, and in that at least two stationary guide elements of the at least one printing assembly define a transport path provided for printing substrate through the printing assembly, and in that a printing section of the transport path provided for printing substrate begins at a first application position in the printing assembly along said provided transport path and ends at a last application position in the printing assembly along said provided transport path, and in that at least five stationary guide elements that together define the provided transport path are arranged one in front of the other along the printing section of said provided transport path.

Preferably, the printing machine is alternatively or additionally characterized in that, along the transport path provided for the printing substrate, downstream of the active zone of the at least one first energy output device, at least one measuring roller and/or at least one first deflecting roller is provided, which is preferably wrapped by the transport path provided for the printing substrate and/or by the printing substrate. Preferably, the printing machine is alternatively or additionally characterized in that, along the transport path provided for the printing substrate, upstream of the active zone of the at least one first energy output device, at least one first feed roller is provided, to which at least one dedicated drive motor is assigned, and which is preferably wrapped by the transport path provided for the printing substrate and/or by the printing substrate, and/or in that, along the transport path provided for the printing substrate, downstream of the active zone of the at least one first energy output device and/or downstream of the at least one measuring roller and/or downstream of the at least one first deflecting roller, at least one second feed roller is provided, which is preferably wrapped by the transport path provided for the printing substrate and/or by the printing substrate. One advantage of this arrangement is that the web tension inside the dryer can thereby be measured or selectively influenced and/or maintained. Preferably, the printing machine is alternatively or additionally characterized in that the at least one second feed roller and/or the at least one measuring roller and/or the at least one first deflecting roller is embodied as at least one cooling roller. One advantage in that case is that high energy input into the dryer is possible because the printing substrate is subsequently cooled again, and as a result, damage to the printing substrate is lower than if the printing substrate were to be held perpetually at correspondingly high temperatures.

Preferably, the printing machine is alternatively or additionally characterized in that at least one, but preferably a plurality of contact pressure rollers, for example at least three, more preferably at least five and even more preferably at least nine, are arranged each pressing individually against the at least one second feed roller. One resulting advantage is that an improvement of the contact of the printing substrate with the second feed roller can then be achieved, thereby facilitating the influence on web tension, while at the same time optionally enabling an improved transfer of heat to the cooling roller.

Preferably, the printing machine is alternatively or additionally characterized in that at least one positioning drive is provided, by means of which the at least one energy output device can be moved along the positioning path. The at least one positioning drive is embodied, for example, as at least one hydraulic drive and/or at least one pneumatic drive. Preferably, the at least one positioning drive is embodied as at least one electric drive and/or more preferably has at least one threaded spindle and at least one threaded nut that cooperates with said spindle. One resulting advantage is that particularly simple and precise positioning movements and adjustments can be carried out.

Preferably, the printing machine having the at least one first printing assembly is characterized in that the at least one dryer unit having the at least one first dryer is located downstream of the at least one first printing assembly along the transport path provided for printing substrate, and has a region of the transport path provided for printing substrate, embodied in particular as a drying section, which is defined by the active zone of the at least one dryer. Preferably over at least half, and more preferably over at least 75% of the entire drying section of the transport path provided for printing substrate, a transport direction provided for the printing substrate has at least one vertical, preferably downward-pointing component, which is greater than any horizontal component of said transport direction that may be present. This results in a particularly safe construction, because even in the event of a shutdown and/or a tearing of the printing substrate web, printing substrate is not allowed to lie directly above and/or on hot components of the dryer where it could become damaged or even catch fire.

The axial direction or transverse direction is defined by a rotational axis of the at least one first feed roller and/or a rotational axis of the at least one second feed roller. The positioning direction of the at least one energy output device is preferably linear. The positioning direction of the at least one energy output device deviates from the axial direction or transverse direction by at least 50°, preferably at least 60°, more preferably at least 75° and even more preferably at least 85°. At the same time, the positioning direction of the at least one energy output device preferably deviates from at least one horizontal direction by no more than 40°, preferably no more than 30°, more preferably no more than 15° and even more preferably, no more than 5°.

Solvent and/or moisture from the printing substrate web and/or from the printing fluid located thereon is preferably removed by means of the radiation emitted by the at least one energy output device and is absorbed by the ambient air in the interior of the at least one first dryer. The transport path of the printing substrate web extends through said interior of the at least one first dryer. To achieve perpetually high drying power, for example, care is taken to ensure that the temperature of components of the at least one first dryer is controlled and/or that the interior of the at least one first dryer is vented. For this purpose, at least one ventilation device is preferably located in the region of the at least one energy output device. The at least one dryer is preferably at least also embodied as an air flow dryer. In an alternative exemplary embodiment, the at least one dryer is embodied exclusively as an air flow dryer.

The ventilation device preferably has at least one air supply line and at least one air removal line. Thus, in addition to being embodied as a radiation dryer, the at least one first dryer is preferably likewise embodied as an air flow dryer. The at least one air supply line is preferably located between at least two air removal lines along the transport path provided for printing substrate. Preferably, the at least one air supply line is at least one energy output device, and at least one radiation source is likewise at least one energy output device. The at least one air supply line and/or the at least one air removal line each preferably have at least one flexible region, with which they are connected to a stationary air transport device.

Preferably, the printing machine is alternatively or additionally characterized in that at least one barrier device is provided, by means of which a safety zone is and/or can be isolated from a surrounding area. The safety zone is preferably a zone that comprises at least every volume that can be occupied by the at least one energy output device and optionally also by at least one dryer stand that supports the at least one energy output device during its movements along the positioning path. More preferably, the safety zone also encompasses a larger space. The safety zone can preferably be entered from the surrounding area via at least one closeable opening in the barrier device. Said at least one opening can preferably be closed by means of a closing device, for example at least one door. Preferably, the at least one energy output device can be moved, in particular, out of its active position and/or its access position and/or its threading position only when the at least one closing device is closed and/or when a signal generator located outside of the safety zone is actuated. The at least one closing device is preferably opened only when the at least one energy output device is arranged in its access position.

Preferably, the printing machine is alternatively or additionally characterized in that the at least one printing assembly has at least two image producing devices, embodied in particular as print heads, by means of each of which application positions for printing fluid are defined. Preferably, in particular a first transport path provided for printing substrate through the printing assembly is defined by at least two guide elements of the printing assembly. More preferably, said at least two guide elements are preferably at least two preferably stationary guide elements of the printing assembly. A printing section of the transport path provided for printing substrate preferably begins at a first application position in the printing assembly along said provided transport path and said printing section preferably ends at a last application position in the printing assembly along said provided transport path. Because the guide elements are stationary, they can be particularly simple in configuration. It is also possible to achieve very large print widths without problems with sagging guide elements. A print head is preferably an image producing device for a non-impact printing method, in other words a printing method without a fixed printing forme.

The printing assembly is preferably characterized in that at least two, preferably at least five, more preferably at least eight, even more preferably at least ten, even more preferably at least fourteen, and more preferably still, at least twenty-eight stationary guide elements that together define the provided transport path are arranged one in front of the other along the printing section of said provided transport path. This results in the advantage, in particular, that an especially large number of print heads and thus a high printing speed and a high print quality can be achieved.

A stationary guide element in this case is understood in particular as a guide element that remains immovable and/or stationary during a printing operation, and/or that is not rotatable by means of its own drive or by contact with printing substrate, and/or that, with respect to rotational movements and/or swiveling movements and/or pivoting movements about axes that are oriented orthogonally to a transport direction of the transport path provided for printing substrate, is intended at most to execute pivoting movements together with other guide elements about at least one common pivot axis. In particular, the at least one printing assembly is preferably characterized in that the at least two and more preferably the at least five, in particular stationary guide elements are preferably stationary guide elements with respect to swiveling movements or pivoting movements about axes other than at least one pivot axis that is common to them. Preferably, the stationary guide elements are, in particular, guide elements that are stationary relative to one another.

Preferably, the printing assembly is alternatively or additionally characterized in that the at least two and more preferably at least five stationary guide elements each have a deflection angle of at least 0.5°, more preferably at least 1° and even more preferably at least 1.5°, and of preferably no more than 5°, more preferably no more than 3°, and even more preferably 2.5° in relation to the transport path provided for the printing substrate. This results, in particular, in the advantage that a particularly flat profile of the printing section of the provided transport path can be achieved, thereby allowing a very large number of print heads to be arranged one in front of the other. In addition, with a small deflection angle, friction between the printing substrate and the stationary guide elements, in particular, is reduced.

A transverse direction is preferably a horizontal direction, oriented orthogonally to the transport path provided for printing substrate through the at least one printing assembly. Preferably, the printing assembly is alternatively or additionally characterized by the fact that the at least two, in particular, and preferably at least five stationary guide elements each have a radially symmetrical or even circular cross-section over more than half of their extension in the transverse direction. Radial symmetry or rotational symmetry is understood as a form of symmetry in which the rotation of an object around a certain rotational angle about an axis, in particular an axis of rotation or axis of symmetry, will bring said object back into alignment with itself. The printing assembly is preferably alternatively or additionally characterized in that an outer surface of each of the at least two, in particular, and preferably at least five guide elements is configured in the shape of a cylindrical shell, at least within a working region of the printing assembly. This results, in particular, in the advantage that, when the surface sections of the guide elements that come into contact with the printing substrate become worn, the guide elements can simply be rotated about a certain, for example predefined angle and then reinstalled or secured, and can then continue to be used. If the deflection angle is very small, a particularly large number of possible renewed uses of the web guide elements is obtained.

Preferably, the printing assembly is alternatively or additionally characterized in that said at least two and preferably at least five guide elements that together define said provided transport path in the region of the printing section are arranged so as to pivot about at least one pivot axis common to them, in particular to move said at least two and preferably at least five guide elements between a respective working position and a respective maintenance position. Preferably, said at least two and preferably at least five guide elements that together define said provided transport path in the region of the printing section are arranged so as to pivot about the at least one pivot axis common to them by means of at least one pivot drive and/or in at least one common movement and/or relative to the at least two print heads. This results, in particular, in the advantage that a maintenance space, in particular for cleaning a shielding device and/or the guide elements, can be created. Preferably, the printing assembly is alternatively or additionally characterized in that said at least two and more preferably at least five guide elements are arranged so as to pivot with a pivot angle of at least 10°, more preferably at least 20° and even more preferably at least 30° about the at least one pivot axis common to them.

Preferably, the printing assembly is alternatively or additionally characterized in that a main conveying direction, which is defined by a rectilinear connection between a first guide element with respect to the printing section of the transport path provided for the printing substrate and a last guide element with respect to the printing section of the transport path provided for printing substrate, is oriented orthogonally to the transverse direction, and in that when the guide elements are arranged in their maintenance position, the main conveying direction is disposed at an angle of at most 30°, more preferably at most 20° and even more preferably at most 10° in relation to a vertical direction. This results in the advantage, in particular, that the maintenance space is particularly large, and the guide elements are particularly readily accessible in their maintenance position. In particular, this enables large printing substrate widths or working widths of the printing assembly to be realized.

Preferably, the printing assembly is alternatively or additionally characterized in that, when the guide elements are arranged in their working position, the main conveying direction is aligned at an angle of at least 10°, more preferably at least 20°, and even more preferably at least 30°, and in particular independently thereof, at an angle of no more than 70°, more preferably no more than 55° and even more preferably no more than 40° in relation to a horizontal plane. This results in the advantage, in particular, that even the bottommost print heads are not arranged at an overly steep angle, and that an ascending profile of the printing section is nevertheless enabled. The upward slope allows the web to be guided immediately thereafter through a dryer substantially from the top downward, without bringing deflection means into contact with the freshly printed side of the web. Preferably, the printing assembly is alternatively or additionally characterized in that the transport path provided for printing substrate is curved along the printing section in only one direction, in particular downward and/or convex with respect to the side of the printing substrate that is imprinted in the at least one printing assembly. A downward curvature is not at variance with a transport path that travels upward, and instead means, for example, an upward slope that continuously or gradually becomes less steep over the course of the transport path. Preferably, the printing assembly is alternatively or additionally characterized in that the transport path provided for printing substrate is bordered and/or contacted along the printing section on precisely one side by components of the printing assembly, or forms a tangent thereto.

Preferably, the printing assembly is alternatively or additionally characterized in that the at least two print heads each have a plurality of nozzles, and in that further preferably, at least one nozzle of each print head has a target region that intersects at least one and more preferably precisely one of the at least two in particular, and more preferably at least five preferably stationary guide elements. This preferably applies, in particular, when each respective print head is arranged in its printing position and when each respective guide element is arranged in its working position. Preferably, this applies alternatively or additionally to multiple or more preferably to all nozzles of the print head in question. This results in the advantage, in particular, that the printing fluid is applied to the printing substrate in a region in which the latter is particularly flat because it is pulled against the corresponding guide element as a result of the deflection angle. Water-based printing fluid, in particular, generally causes the printing substrate to swell, which can lead to deformations, in particular rippling in the printing substrate. This is particularly critical in the case of print images that do not cover the entire surface and/or variable print images. The alignment of the nozzles toward the guide elements and thus toward the flattened regions of the printing substrate reduces and/or prevents printing errors and/or damage to the nozzles, which are arranged with only slight spacing on the provided transport path. In particular, assuming such deformations do not occur to an excessive extent, all of the nozzles may also have target regions that do not intersect any of the at least two in particular, and more preferably at least five preferably stationary guide elements, and instead extend exclusively between the guide elements, passing by the guide elements.

Preferably, the printing assembly is alternatively or additionally characterized in that at least one of the at least two and preferably at least five guide elements that together define said provided transport path in the region of the printing section is in contact with a total of at least two lateral support elements and at least one inner support element, at three points that are preferably configured as bearing regions and are spaced from one another in the transverse direction, and as a result, the position of said guide element is defined. Further preferably, the printing assembly is alternatively or additionally characterized in that a plurality, or even more preferably all of the at least two and preferably at least five guide elements that together define said provided transport path in the region of the printing section are in contact with a total of at least two lateral support elements and at least one inner support element, at three locations that are spaced from one another in the transverse direction and are preferably embodied as bearing regions, thereby fixing said guide elements in position, wherein preferably the plurality of guide elements or more preferably all of the guide elements are each in contact with the same lateral and/or inner support elements. This also produces a bracing effect on the guide elements between the outer ends of the guide elements; as a result, the guide elements have a decreased tendency, or even no tendency at all, to be deflected by the force of gravity and/or by web tension. Such sagging would otherwise impact the distance between nozzles and printing substrate, in particular. In this manner, high print image quality is ensured, even with large web widths. Preferably, the printing assembly is alternatively or additionally characterized in that the at least one inner support element is in contact with the at least one guide element at a location that is preferably embodied as a bearing region, with the position of said guide element with respect to the transverse direction coinciding with the position of at least one nozzle of at least one print head of the printing assembly.

Preferably, the printing assembly is alternatively or additionally characterized in that the at least one threading means for threading-in a printing substrate web, which threading means is movable along the at least one threading path and is further preferably different from any printing substrate, is and/or can be arranged, at least intermittently, within the at least one printing assembly. This results in the advantage, in particular, that an especially simple and safe threading of printing substrate into the printing assembly and/or the printing machine is enabled, which is particularly important in the case of large web widths.

Preferably, the printing assembly is alternatively or additionally characterized by the fact that the printing assembly has at least one in particular immovable stand or machine stand, and in that the printing assembly has the at least one first transport path, which is defined by at least two guide elements together and is provided for webs of printing substrate, and also has at least one support element that is movable, in particular pivotable relative to the stand, and in that at least one first web fixing device for fixing a first section of a printing substrate web relative to the first web fixing device and/or relative to the stand is provided along this first provided transport path. Fixing is understood, in particular, not merely as a bracing against gravitational force, but rather as a relative immobility, in particular with respect to any movement in any direction. Preferably, the printing assembly is alternatively or additionally characterized in that, along this first provided transport path, and in particular downstream of the at least one first web fixing device, at least one second web fixing device, which is connected to the at least one support element that is movable relative to the stand and is likewise movable relative to the stand, at least together with said at least one support element that is movable relative to the stand, is provided for fixing a second section of a printing substrate web relative to the second web fixing device and/or relative to the at least one movable support element. The at least one first web fixing device is preferably arranged on the stand.

Preferably, the printing assembly is alternatively or additionally characterized in that the at least two guide elements that together define the first transport path provided for printing substrate are arranged, preferably on said at least one support element, so as to move, in particular pivot, together with the at least one support element, relative to the stand. Preferably, the printing assembly is alternatively or additionally characterized in that the at least one support element is arranged so as to pivot, together with the at least one second web fixing device and/or together with the at least two guide elements, about the at least one common pivot axis. The at least one second web fixing device is preferably arranged so as to be movable independently of the at least one first web fixing device. Preferably, the printing assembly is alternatively or additionally characterized by the fact that the second web fixing device is movable relative to the first web fixing device, in particular together with the at least two guide elements, and in that the distance between the at least one second web fixing device and the at least one first web fixing device can be adjusted. Preferably, the printing assembly is alternatively or additionally characterized in that the at least one first web fixing device is disposed on the stand of the printing assembly. Preferably, the printing assembly is alternatively or additionally characterized in that an optionally provided maximum displacement path of the at least one first web fixing device is less than one-tenth of the maximum displacement path of the at least one second web fixing device.

Preferably, the printing assembly is alternatively or additionally characterized in that the at least one second web fixing device, in particular together with the part of the second section of the at least one printing substrate web that is fixed thereto, can be arranged at different distances from the at least one image producing device, which is preferably embodied as a print head.

Preferably, the printing assembly is alternatively or additionally characterized in that the printing assembly has at least two image producing devices, each of which defines application positions for printing fluid, and in that a printing section of the first transport path provided for printing substrate begins at a first application position in the printing assembly along said provided transport path and ends at a last application position in the printing assembly along said provided transport path, and in that along said provided transport path, the at least two guide elements that together define the provided transport path are arranged one in front of the other along the printing section of said first provided transport path.

Preferably, the printing assembly is alternatively or additionally characterized in that at least one severing device and/or at least one connecting device is disposed along the provided transport path between the at least one first web fixing device and the at least one second web fixing device. Preferably, the printing assembly is alternatively or additionally characterized in that the first section of the printing substrate web and the second section of the printing substrate web are part of the same printing substrate web, at least prior to a possible severing.

Preferably, the printing assembly is alternatively or additionally characterized in that the at least one first web fixing device and/or the at least one second web fixing device is or are embodied as a suction device. Preferably, the printing assembly is alternatively or additionally characterized in that the at least one first web fixing device and/or the at least one second web fixing device is or are embodied as a clamping device.

Preferably, the printing assembly is alternatively or additionally characterized in that the at least one first web fixing device and the at least one second web fixing device are arranged at least twice as far, more preferably at least five times as far and even more preferably at least ten times as far from a roll holding device and/or from a post-processing device as from the next closest application position to them in the printing assembly along the transport path provided for printing substrate.

The invention can preferably be used with various non-impact printing methods, in particular for ionographic methods, magnetographic methods, thermographic methods, electrophotography, laser printing and in particular inkjet printing methods. In the foregoing and in the following, embodiments and variants that are described for "printing inks"—except where an obvious contradiction is clear—can be applied to any type of flowable printing fluids, including in particular colored or colorless varnishes and relief-producing materials such as, for example, pastes, and can be transferred by a—suggested or actual—replacement of the expression "printing ink" with the broader term "printing fluid" or with the specialized expression "varnish", "high-viscosity printing ink", "low-viscosity printing ink" or "ink", or "paste" or "pasty material".

The printing machine can be used in particular for carrying out a preferred method for operating a printing machine. This is a method for operating the printing machine, in which the printing machine has the at least one first printing assembly and the at least one dryer unit, and in which the at least one dryer unit has the at least one first dryer with at least the first energy output device. In a first deactivation process, the at least one first energy output device is preferably moved, in particular by means of the at least one positioning drive, in the positioning direction along a positioning path by at least 5 mm, preferably by at least 50 mm and more preferably by at least 90 mm, and independently thereof, for example, by at most 400 mm, out of the active position into the threading position, and is halted there. The positioning path extends in a continuously linear fashion in and/or opposite the positioning direction over at least 75% of its total length, preferably over at least 90% of its total length, and more preferably over its entire total length. In other words, in the first deactivation process, the at least one energy output device is preferably moved, in particular by means of the at least one positioning drive, at least 5 mm, preferably at least 50 mm and more preferably at least 90 mm, and independently thereof, for example, no more than 400 mm in the positioning direction along the at least 75% linear positioning path from the active position to the threading position, and is halted there. For the first deactivation process, rather than using the entire positioning path, that is, in particular the total length of the positioning path, less than 25%, more preferably less than 10% is used.

In a subsequent threading process, at least one web-type printing substrate is preferably drawn along the transport path provided for the printing substrate through the active zone of the at least one energy output device by means of at least one threading means, which is different in particular from any printing substrate. Further preferably, in a subsequent first resetting process, the at least one first energy output device is moved, in particular by means of the at least one positioning drive, back from the threading position, opposite the positioning direction, along the same linear positioning path to the active position, and is halted there. As described, the positioning direction deviates by no more than 40°, preferably no more than 30°, more preferably no more than 15° and even more preferably no more than 5° from the normal direction, said normal direction being the normal direction of the mean surface normal of the entire section of the transport path provided for web-type printing substrate, which section lies, in particular, in the entire active zone of the at least one first energy output device.

Between the first deactivation process and a second deactivation process, in at least one drying process, energy is preferably delivered in the active zone of the first energy output device by the at least one first energy output device to the web-type printing substrate that was previously threaded in. Further preferably, the web-type printing substrate that was previously threaded-in has already been provided at least partially with at least one printing fluid in the at least one printing assembly.

In a second deactivation process, which takes place subsequently, in particular, the at least one first energy output device is preferably moved, in particular, along the same positioning path, which extends in and/or opposite positioning direction S in a continuously linear fashion over at least 75%, more preferably at least 90% and even more preferably 100% of its total length, at least 450 mm, more preferably at least 600 mm and even more preferably at least 700 mm in particular in the same positioning direction, in particular by means of the at least one positioning drive, from the active position to an access position that is different from the threading position, and is halted there. In a subsequent first maintenance process, at least one maintenance task is preferably performed on the at least one first energy output device, for example at least one current-carrying component is replaced and/or one component is cleaned. Further preferably, in a subsequent second resetting process, the at least one first energy output device is moved back, in particular by means of the at least one positioning drive, opposite the positioning direction along the same linear adjustment path from the access position to the active position, and is halted there.

The method is preferably characterized in that the at least one threading means is connected in a connecting procedure to the at least one printing substrate web by means of at least one connecting element. The at least one connecting element preferably passes through a printing position of the at least one print head while the latter is moved away from the provided transport path and/or is arranged in at least one idle position, and/or the at least one connecting element passes through at least one target region of at least one nozzle of the at least one print head during the threading process, and/or no component of the at last one threading means passes through a target region of a nozzle of the at least one print head during the threading process. Preferably, the at least one connecting element passes through an active zone of the at least one energy output device of the at least one first dryer while the energy output device is in a deactivated position embodied as a threading position. Preferably, only at least one threading means is used, said threading means being arranged on only one side of the provided transport path for printing substrate with respect to the axial direction, and/or the threading path of said threading means extending on only one side of the provided transport path for printing substrate.

BRIEF DESCRIPTION OF THE DRAWINGS

Exemplary embodiments of the invention are illustrated in the set of drawings and will be described in greater detail in the following.

The drawings show.

DESCRIPTION OF PREFERRED EMBODIMENTS

Figure 1:
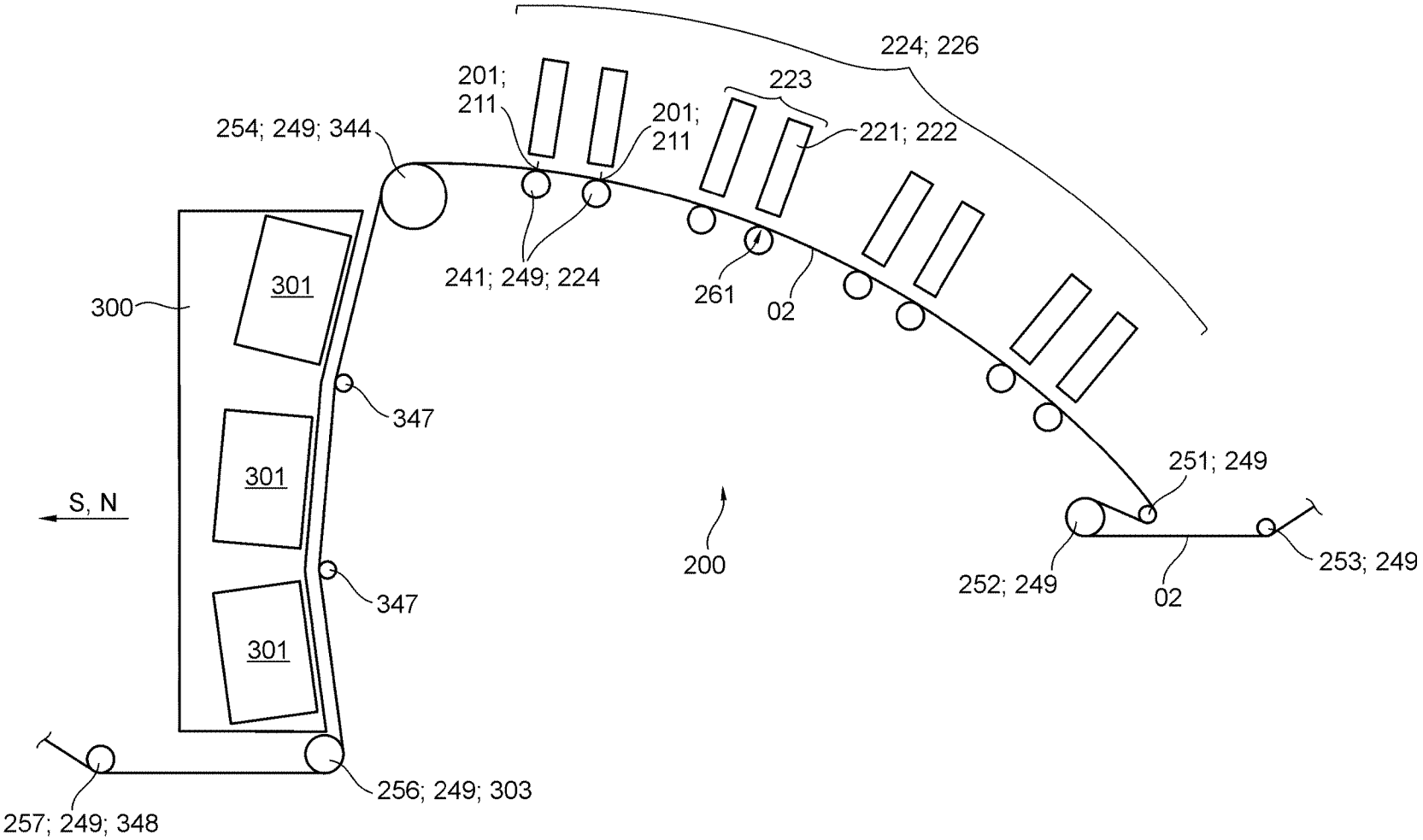
FIG. 1 a schematic diagram of a transport path for printing substrate through a printing assembly and a dryer.

In the foregoing and in the following, the term printing fluid includes inks and printing inks, but also varnishes and pasty materials. Printing fluids are preferably materials that are and/or can be transferred by means of a printing machine 01 or at least one printing assembly 200 of the printing machine 01 onto a printing substrate 02, and which thereby create on the printing substrate 02 a texture, preferably in finely structured form and/or not merely over a large area, which texture is preferably visible and/or perceptible by the senses and/or detectable by machine Inks and printing inks are preferably solutions or dispersions of at least one colorant in at least one solvent. Suitable solvents include water and/or organic solvents, for example. Alternatively or additionally, the printing fluid can be embodied as printing fluid that is cross-linked under UV light. Inks are relatively low-viscosity printing fluids and printing inks are relatively high-viscosity printing fluids. Inks preferably contain no binding agent or relatively little binding agent, whereas printing inks preferably contain a relatively large amount of binding agent, and further preferably contain additional auxiliary agents. Colorants may be pigments and/or dyes, with pigments being insoluble in the application medium, whereas dyes are soluble in the application medium.

In the interest of simplicity, in the foregoing and in the following—unless explicitly distinguished and specified accordingly—the term "printing ink" or "printing fluid" is understood as a liquid or at least flowable coloring fluid to be used for printing in the printing machine, and is not restricted to the higher viscosity coloring fluids more frequently associated colloquially with the expression "printing ink" for use in rotary printing machines, but in addition to these higher viscosity coloring fluids particularly also includes lower viscosity coloring fluids such as "inks", in particular inkjet inks, but also powdered coloring fluids, such as toners, for example. Thus in the foregoing and in the following, when printing fluids and/or inks and/or printing inks are mentioned, this also includes colorless varnishes. In the foregoing and in the following, when printing fluids and/or inks and/or printing inks are mentioned, this also preferably includes, in particular, means for pretreating (precoating) the printing substrate 02. The term coating agent may be understood as synonymous with the term printing fluid.

A printing machine 01 should be understood here as a machine that applies or is capable of applying at least one printing fluid to a printing substrate 02. A printing machine 01 preferably has at least one printing substrate source, preferably at least one first printing assembly 200, preferably at least one first means that assists with drying, i.e. first auxiliary drying means 301, for example a first dryer 301, and preferably at least one post-processing device. Where appropriate, printing machine 01 has, for example, at least one second printing assembly and, for example, at least one second means that assists with drying, i.e. auxiliary drying means, for example a second dryer. Printing machine 01 is preferably embodied as inkjet printing machine 01. Preferably, printing machine 01 is embodied as a web-fed printing machine 01, more preferably as a web-fed inkjet printing machine 01. Printing machine 01 can be embodied as a printing machine 01 that operates based on the inkjet method—as a whole or optionally in addition to other non-impact printing methods and/or printing forme-based methods—in particular as an inkjet printing machine 01. The at least one first printing assembly 200 is preferably embodied as at least one first inkjet printing assembly 200. In particular, printing assembly 200 is preferably a printing assembly 200 for processing web-type printing substrate 02.

In the case of a web-fed printing machine 01, the printing substrate source is embodied as a roll unwinding device. In the printing substrate source, at least one printing substrate 02 is preferably aligned, preferably with respect to at least one edge of said printing substrate 02. In the roll unwinding device of a web-fed printing machine 01, at least one web-type printing substrate 02, that is, a printing substrate web 02, preferably a paper web 02, is unwound from a printing substrate roll 101 and is preferably aligned with respect to its edges in an axial direction A. Axial direction A is preferably a direction A that extends in a transverse direction A, parallel to a rotational axis of a roll of printing substrate. Transverse direction A is preferably a horizontally extending direction A. Transverse direction A is oriented orthogonally to the provided transport direction of printing substrate 02 and/or orthogonally to the provided transport path of printing substrate 02 through the at least one first printing assembly 200. Downstream of the at least one printing substrate source, a transport path of the at least one printing substrate 02 and, in particular, the printing substrate web 02 preferably extends through the at least one first printing assembly 200, where the printing substrate 02 and in particular the printing substrate web 02 is preferably provided on one side with a printed image by means of at least one printing ink.

In the case of a curved transport path, the transport direction is preferably the direction that in each case extends tangentially to a section and/or point on the provided transport path that is closest to a respective reference point. Said respective reference point is preferably located at the point and/or on the component that is placed in relation to the transport direction.

In the following, the invention will be described in connection with an inkjet printing machine 01. However, the invention may also be used for other non-impact printing methods or for completely different printing methods, such as, for example, rotary printing, offset printing, lithography, letterpress printing, screen printing or gravure printing, as long as no contradictory circumstances exist.

The roll unwinding device preferably has a dancer roller, preferably arranged deflectably on a dancer lever, and/or a first web edge aligner and/or an infeed mechanism, which has an infeed nip formed by a feed roller and a pressing feed roller, and a first measuring device embodied as a first measuring roller, in particular as an infeed measuring roller, downstream of a roll holding device along the provided transport path of the printing substrate web 02. Said feed roller preferably has its own drive motor, embodied as a feed drive motor, and is preferably connected to a machine controller. The dancer roller may be used for adjusting a web tension and holding said web tension within limits, and/or is preferably used for holding the web tension within limits. The roll unwinding device optionally has a splicing and cutting device, by means of which a roll change can be carried out on a flying basis, that is, without stopping the printing substrate web 02. The infeed mechanism is preferably located downstream of the first web edge aligner. The at least one feed roller is preferably provided as a component of the infeed mechanism, and together with the pressing feed roller, preferably forms the infeed nip. The infeed nip serves to regulate the web tension and/or to transport the printing substrate 02.

A printing assembly 200 is understood as an apparatus by means of which a web-type or sheet-type printing substrate 02 is or can be furnished with at least one printing fluid on at least one of its sides. The at least one first printing assembly 200 of printing machine 01 preferably has at least one printing position 201. A printing position 201 is understood here as preferably an entire region in which contact is or can be established between the same printing fluid and a printing substrate 02. The term printing position 201 should also be used in cases in which the printing fluid is applied to the printing substrate 02 without pressure between printing substrate 02 on one side and a component that transfers the printing fluid on the other side, for example by freely movable printing fluid, for example flying droplets of the printing fluid, striking printing substrate 02. Preferably, a printing position 201 comprises all the regions that are intended for a specific printing fluid, assigned in particular to said printing position 201, to strike printing substrate 02. In the case of a printing assembly 200 that operates according to the inkjet printing method, for example, a printing position 201 encompasses all the regions that are intended for a black ink to strike a first side of printing substrate 02.

The at least one first printing assembly 200 preferably has a plurality of printing positions 201, for example at least four printing positions 201, preferably at least five printing positions 201, more preferably at least six printing positions 201, and even more preferably at least seven printing positions 201, each of which is assigned a respective printing fluid.

A working width of printing machine 01 and/or of the at least one printing assembly 200 is a dimension that preferably extends orthogonally to the provided transport path of printing substrate 02 through the at least one first printing assembly 200, more preferably in the transverse direction A. Transverse direction A is preferably a horizontally extending direction A. Transverse direction A is oriented orthogonally to the provided transport direction of printing substrate 02 and/or orthogonally to the provided transport path of printing substrate 02 through the at least one printing assembly 200. The working width of printing machine 01 preferably corresponds to the maximum width a printing substrate 02 may have in order to still be processed by printing machine 01, that is to say a maximum printing substrate width that can be processed by printing machine 01. The working width of printing machine 01 preferably corresponds to the working width of the at least one first printing assembly 200.

Each printing position 201 preferably has at least one application position 211. Each application position 211 is preferably assigned to at least one image producing device 221, in particular at least one print head 221 and more preferably at least one print head row 222. Each application position 211 preferably extends in the transverse direction A, more preferably over the entire working width of printing machine 01. In the case of an inkjet printing machine 01, the at least one image producing device 221 is preferably embodied as at least one print head 221, in particular an inkjet print head 221. The at least one printing assembly 200 preferably has at least two print heads 221. The at least one printing assembly 200 is characterized, for example, in that the at least two print heads 221 are embodied as print heads 221 configured for a non-impact printing method, and more preferably in that the at least two print heads 221 are embodied as inkjet print heads 221. Image producing devices 221 such as print heads 221, for example, typically have limited dimensions, in particular in the transverse direction A. This results in a limited region of the printing substrate 02 onto which printing fluid can be applied by a respective print head 221. For that reason, a plurality of image producing devices 221 or print heads 221 are typically arranged one in front of the other in the transverse direction A. Such print heads 221 arranged one in front of the other in transverse direction A are referred to as a print head row 222. In the following, discontinuous print head rows 222 and continuous print head rows 222 will be described. In the exceptional case in which a print head 221 extends over the entire working width, said print head should likewise be regarded as a print head row 222, in particular as a continuous print head row 222.

Typically, such individual print heads 221 are not equipped with nozzles all the way up to the edge of their housing. For that reason, preferably at least two and more preferably precisely two print head rows 222 extending in the transverse direction A are arranged offset relative to one another along the transport path provided for the printing substrate 02. Such print head rows 221 are discontinuous print head rows 222, for example. In each case, two such discontinuous print head rows 222, in particular, together form a double row 223 of print heads 221. The correspondingly offset arrangement of print heads 221 of the two discontinuous print head rows 222 preferably allows the entire working width of printing machine 01 and/or of the at least one first printing assembly 200 to be reached by nozzles of the print heads. Preferably, a plurality of print head rows 222, more preferably at least four double rows 223 and even more preferably at least eight double rows 223 of print heads 221 are arranged in succession in a direction orthogonally to transverse direction A, in particular in the direction of transport along the transport path provided for printing substrate 02.

Each nozzle is preferably assigned a clearly defined target region with respect to the direction A of the width of printing substrate web 02 and preferably with respect to the transverse direction A. Each target region of a nozzle is preferably clearly defined, at least during the printing operation. A target region of a nozzle is particularly the spatial, in particular substantially rectilinear region that extends outward from said nozzle in the ejection direction of said nozzle. A striking region is preferably a region that is provided for the contact of printing fluid with printing substrate 02, in particular for the contact of droplets of printing fluid with printing substrate 02. Each nozzle of each print head 221 is preferably assigned a striking region, in particular in a direct inkjet printing process. A striking region of a print head 221 is preferably the sum of all the striking regions of nozzles of said print head 221. An application position 211 is preferably the sum of all the striking regions of, in particular, functionally combined print heads 221, which together span the entire working width of printing machine 01. In the case of pairs of discontinuous print head rows 222 configured as double rows 223, an application position 211 is preferably the sum of the striking regions of the print heads 221 that together form the double row.

A printing assembly 200 may comprise, for example, only one printing position 201, for example for the color black. Preferably, however, the at least one first printing assembly 200 has a plurality of printing positions 201, as described. The printing positions 201 can be directly adjacent to one another in space or can be spaced from one another, for example, separated according to color. The term printing position 201 also covers a section which—for example, without interruption by a different color—has a plurality of successive application positions 211 of the same color. In the case of only one printing position 201, said position acts as both the first and the last printing position 201 of the printing assembly 200 in question.

In the case of an indirect inkjet printing method, for example, a printing position is an area of contact between a transfer body and the printing substrate 02.

The at least one printing assembly 200 preferably has at least one print head 221, which is further preferably embodied as at least one inkjet print head 221. Each print head 221 preferably has a plurality of nozzles from which droplets of printing fluid, in particular ink droplets, are and/or can be ejected. Preferably, the at least one printing assembly 200 has at least one nozzle bar 231. A nozzle bar 231 in this case is a component that preferably extends over at least 80% and more preferably at least 100% of the working width of printing machine 01 and/or preferably serves as the support for the at least one print head 221. In this case, for example, a single or preferably a plurality of nozzle bars 231 are provided for each printing assembly 200. More preferably, the at least one printing assembly 200 has at least three nozzle bars 231, even more preferably at least five nozzle bars 231, and more preferably still, at least fourteen (14) nozzle bars 231. The at least one first nozzle bar 231 preferably extends orthogonally to the provided transport path of printing substrate 02 over the entire working width of printing machine 01, in particular in transverse direction A.

The at least one nozzle bar 231 preferably has at least one print head 221, and preferably each has a plurality of print heads 221. In the case in which the at least one nozzle bar 231 has only one print head 221 each, said print head 221 preferably extends over the entire working width of printing machine 01. In the case in which the at least one nozzle bar 231 has a plurality of print heads 221 each, these print heads 221 are preferably configured as at least one print head row 221 or more preferably as at least one double row 223 of print heads 221, and the at least one print head row 222 or double row 223 of print heads 221 preferably extends over the entire working width of printing machine 01. In the case of a double row 223 of print heads 221, the at least one row of nozzles of each nozzle bar 231 is preferably divided into at least two discontinuous print head rows 222.

The at least one nozzle bar 213 preferably has a plurality of rows of nozzles in the conveying direction of a printing substrate guiding unit 249. Said conveying direction of the printing substrate guiding unit 249 is preferably identical to the transport direction of the transport path provided for the transport of printing substrate 02. Each print head 221 preferably has a plurality of nozzles, which are further preferably arranged in a matrix of multiple rows in transverse direction A and/or multiple columns, preferably in the direction of conveyance of printing substrate guiding unit 249, said columns being arranged extending obliquely to the conveying direction of printing substrate guiding unit 249, for example, to increase the resolution of a printed image, for example.

The at least one print head 221 acts to generate droplets of printing ink, preferably using the drop-on-demand method, in which droplets of printing ink are generated selectively, as needed. Preferably, at least one heating element is used per nozzle, which generates an evaporation of printing fluid within a reservoir. Alternatively, at least one piezoelectric element may be used per nozzle, which is capable of reducing a volume filled with printing ink by a certain percentage at high speed when a voltage is applied.

A conveying line, in particular a conveying line for printing substrate 02, preferably comprises those devices 241; 251; 252; 253; 254; 256; 257; 303; 306; 343; 344 that define a transport path for the printing substrate 02, for example rollers, cylinders, guide elements and the like. A conveying line in the at least one first printing assembly 200 that extends from a first printing position 201 along the transport path provided for printing substrate 02 in the at least one first printing assembly 200 up to a last printing position 201 along the transport path provided for printing substrate 02 in the at least one first printing assembly 200 is referred to as the printing line 224 of the at least one first printing assembly 200. The transport path provided here is the spatial area that printing substrate 02 would occupy if it were present. The conveying line of the at least one first printing assembly 200 preferably comprises those devices 241; 251; 252; 254; 256 that define the transport path through the at least one first printing assembly 200, in particular both the provided transport path, regardless of whether or not printing substrate 02 is present, and the actual transport path when printing substrate 02 is present. The portion of the provided transport path for printing substrate 02 that is defined by printing line 224 is referred to as printing section 226 of the provided transport path.

Figure 2:
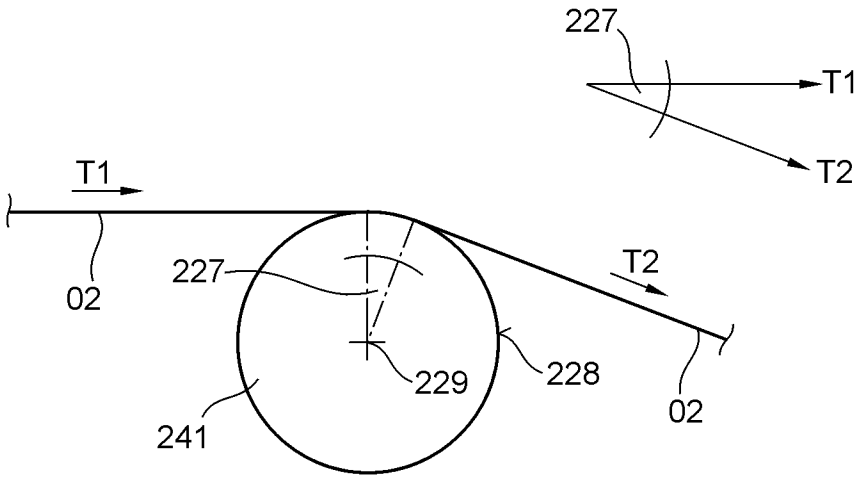
FIG. 2 a schematic diagram of a deflection of a printing substrate on a guide element.
Figure 3:
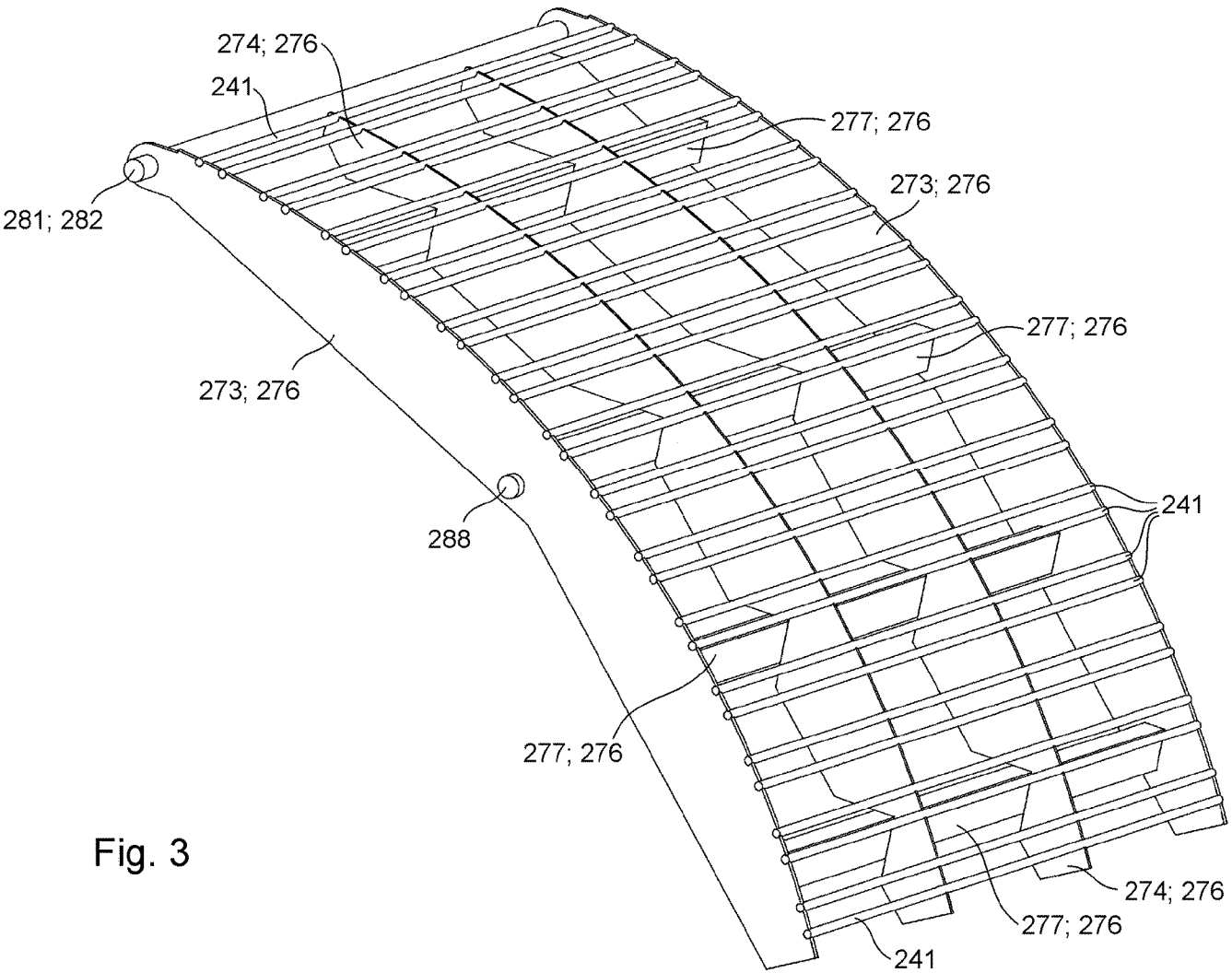
FIG. 3 a schematic diagram of a set of guide elements held by a common support frame.
Figure 4:
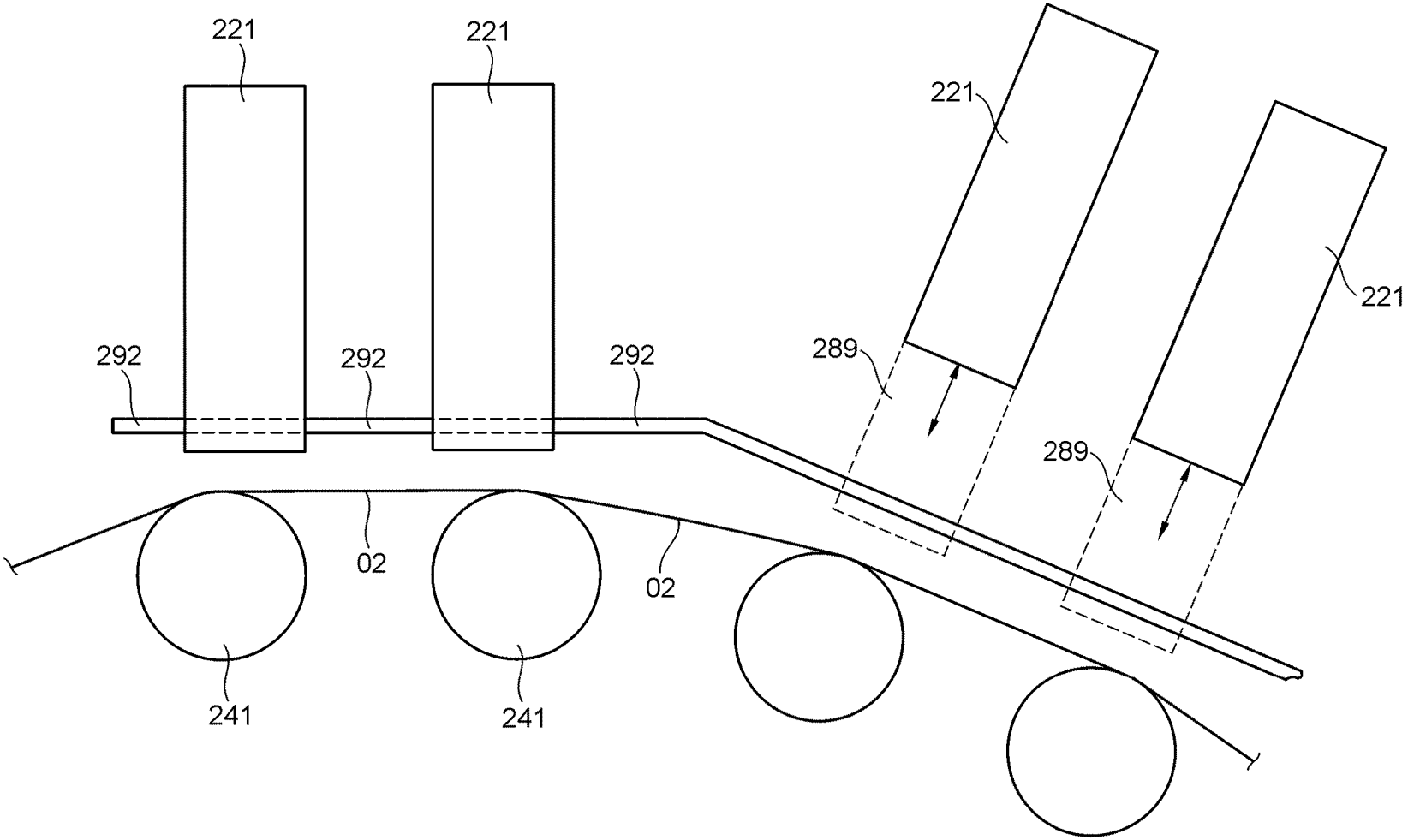
FIG. 4 a schematic diagram of a part of a printing section.
Figure 5A:
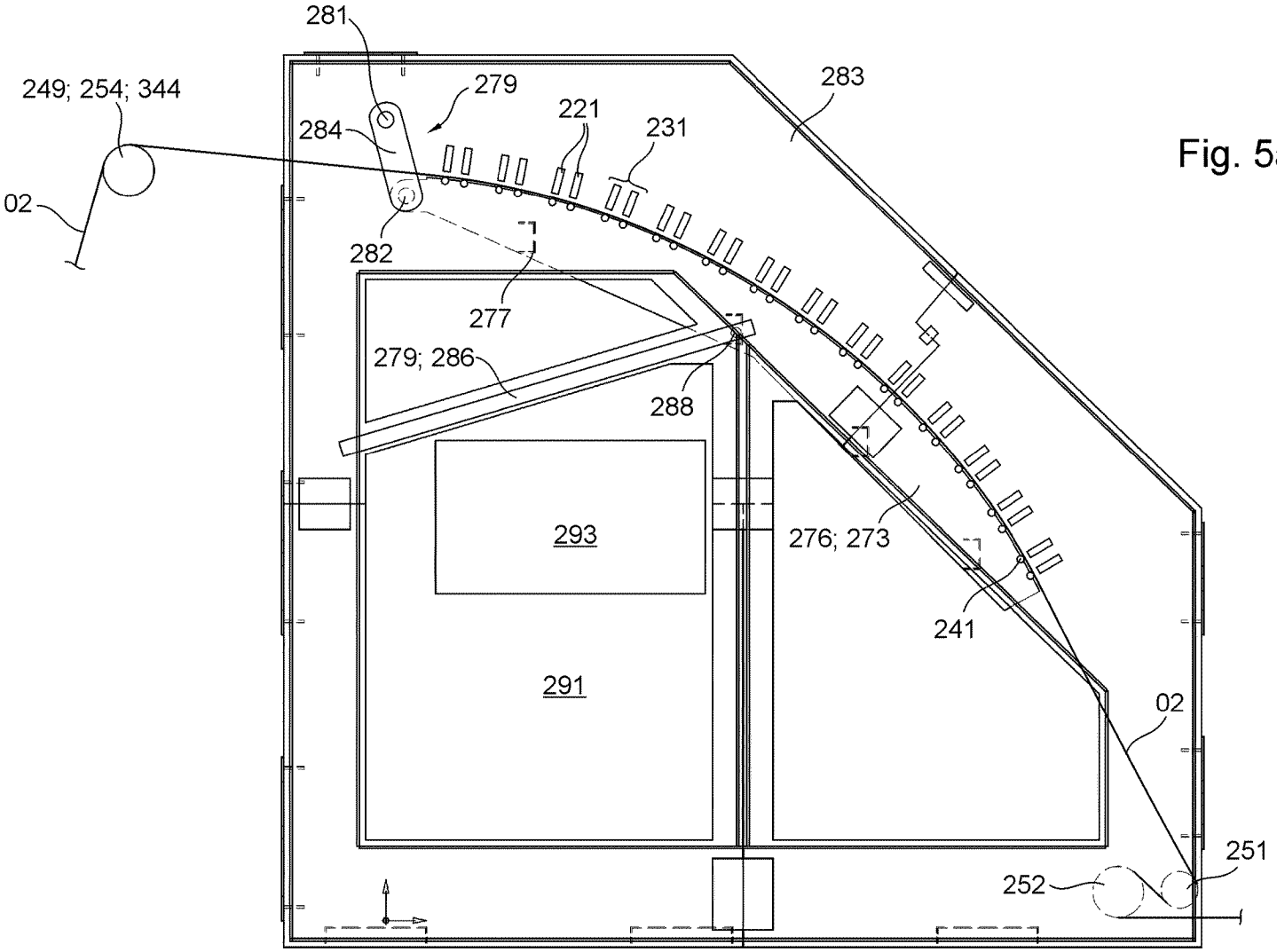
FIG. 5*a* a schematic diagram of a printing assembly having guide elements in a working position and print heads in a printing position.
Figure 5B:
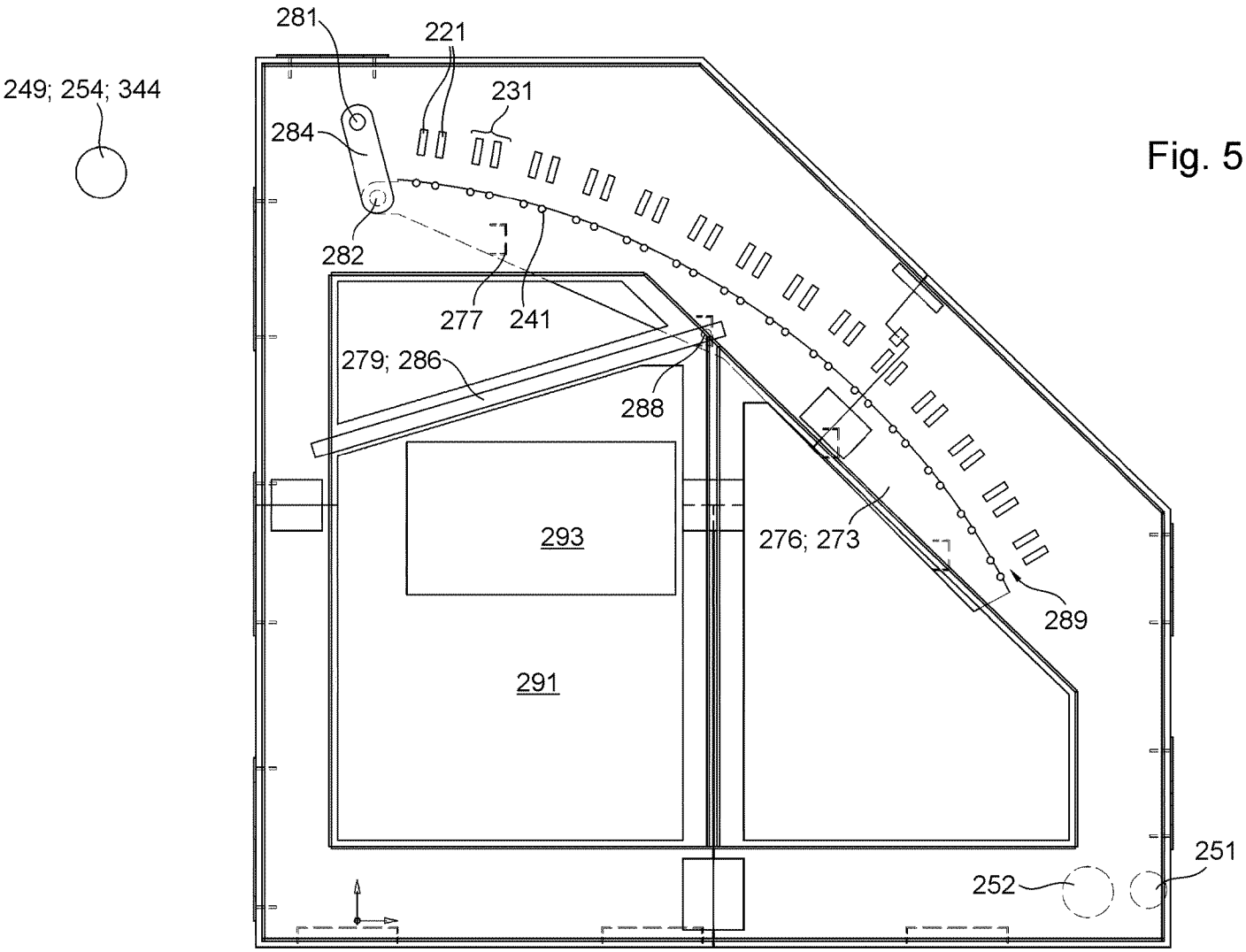
FIG. 5*b* a schematic diagram of the printing assembly according to FIG. 1*a* with guide elements in a working position and print heads in a deactivated position.
Figure 5C:
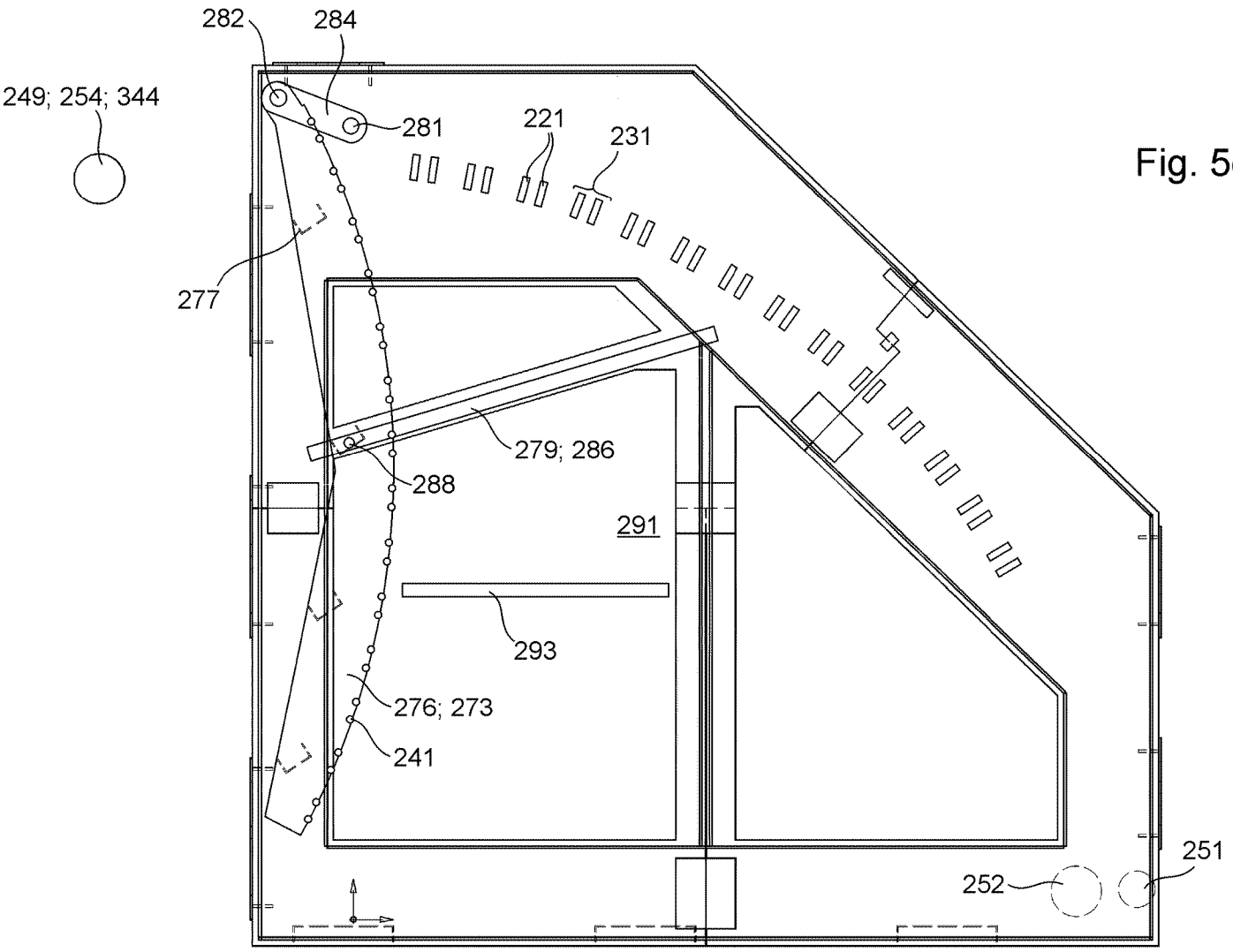
FIG. 5*c* a schematic diagram of the printing assembly according to FIG. 1*a* with guide elements in a maintenance position and print heads in a printing position.
Figure 6A:
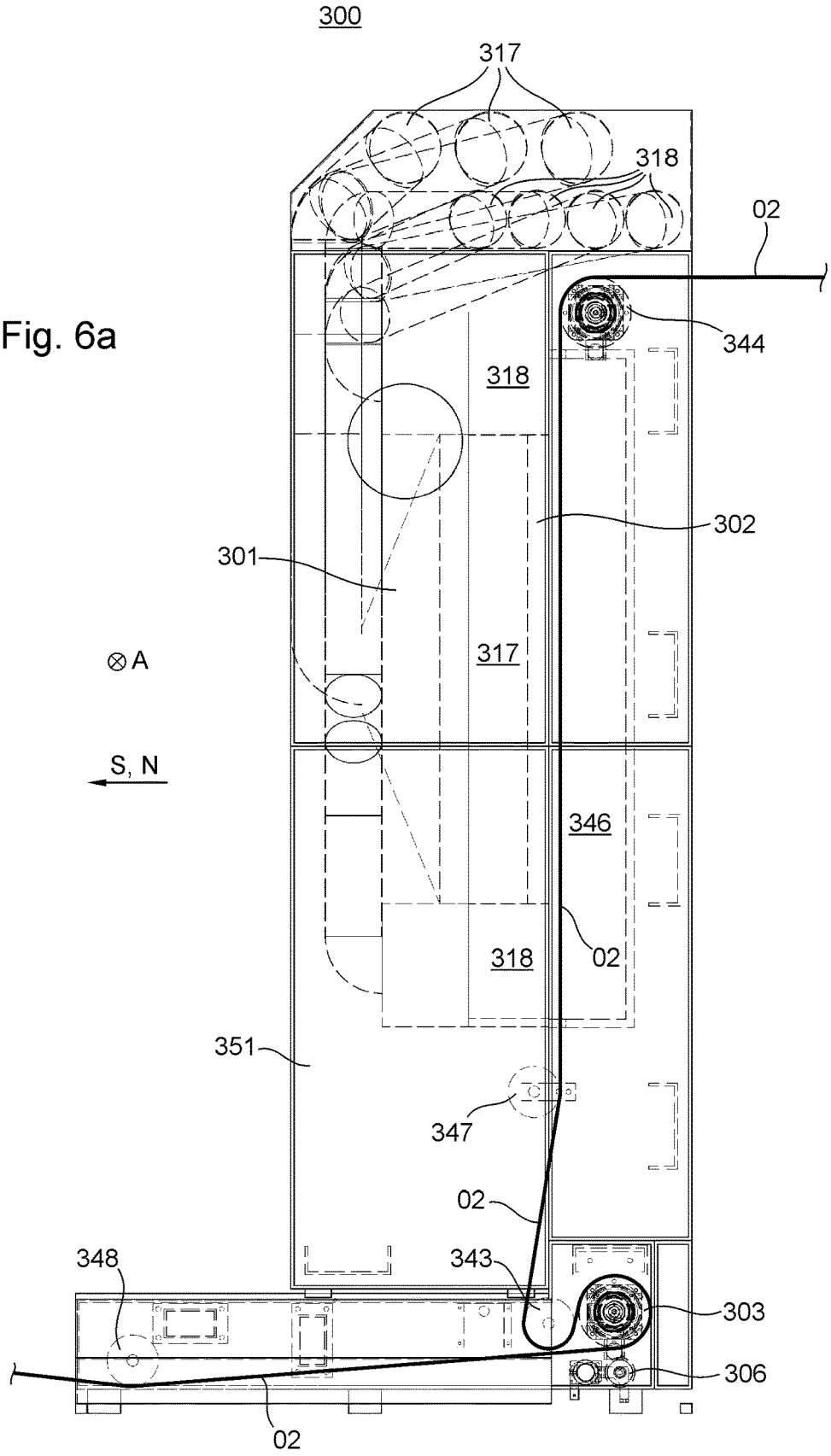
FIG. 6*a* a schematic diagram of a dryer unit of a printing machine, in which an energy output device is arranged in an active position.
Figure 6B:
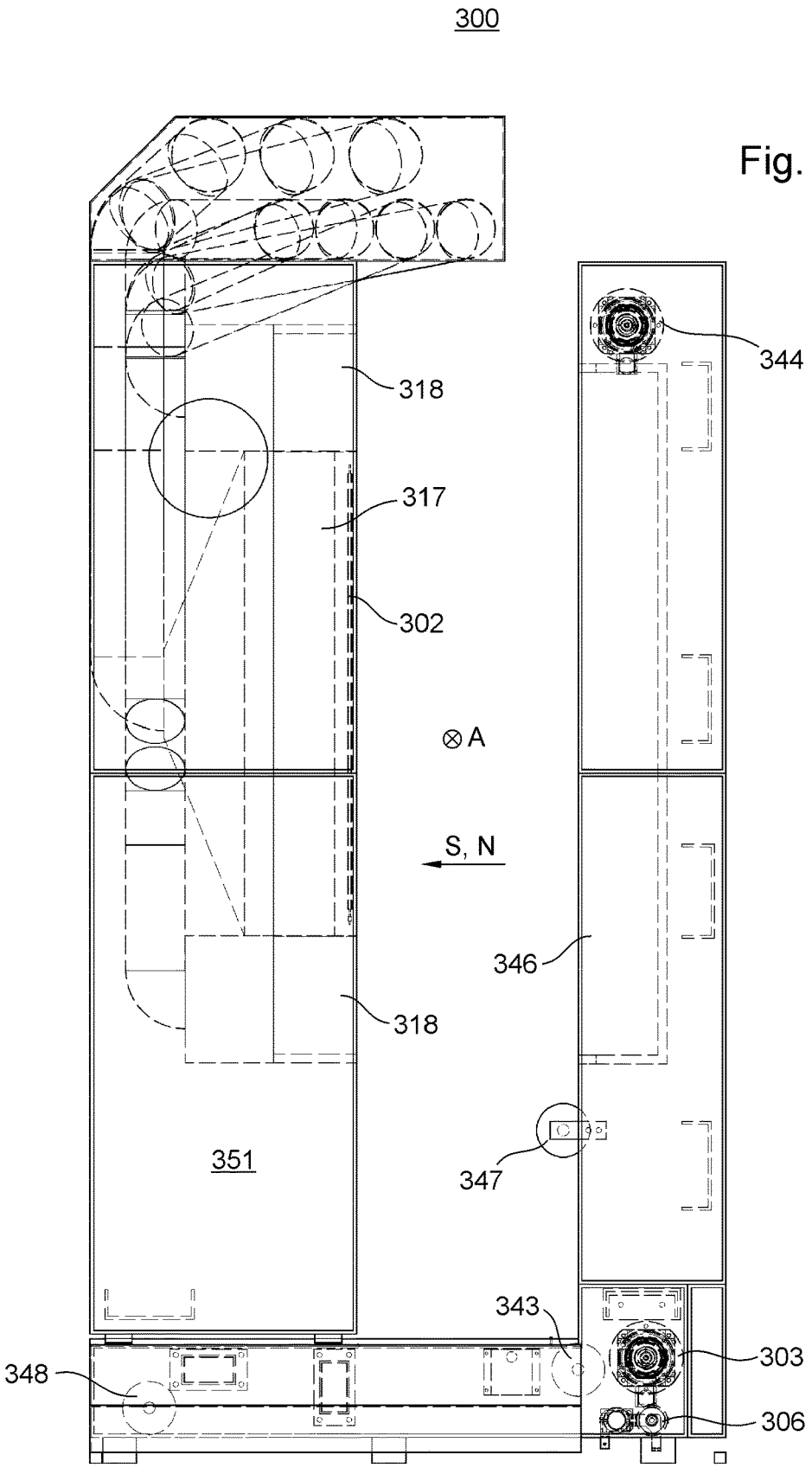
FIG. 6*b* a schematic diagram a schematic diagram of a dryer unit of a printing machine, in which an energy output device is arranged in a deactivated position embodied as an access position, and in which a printing substrate or at least the transport path provided for it is marked.
Figure 6C:
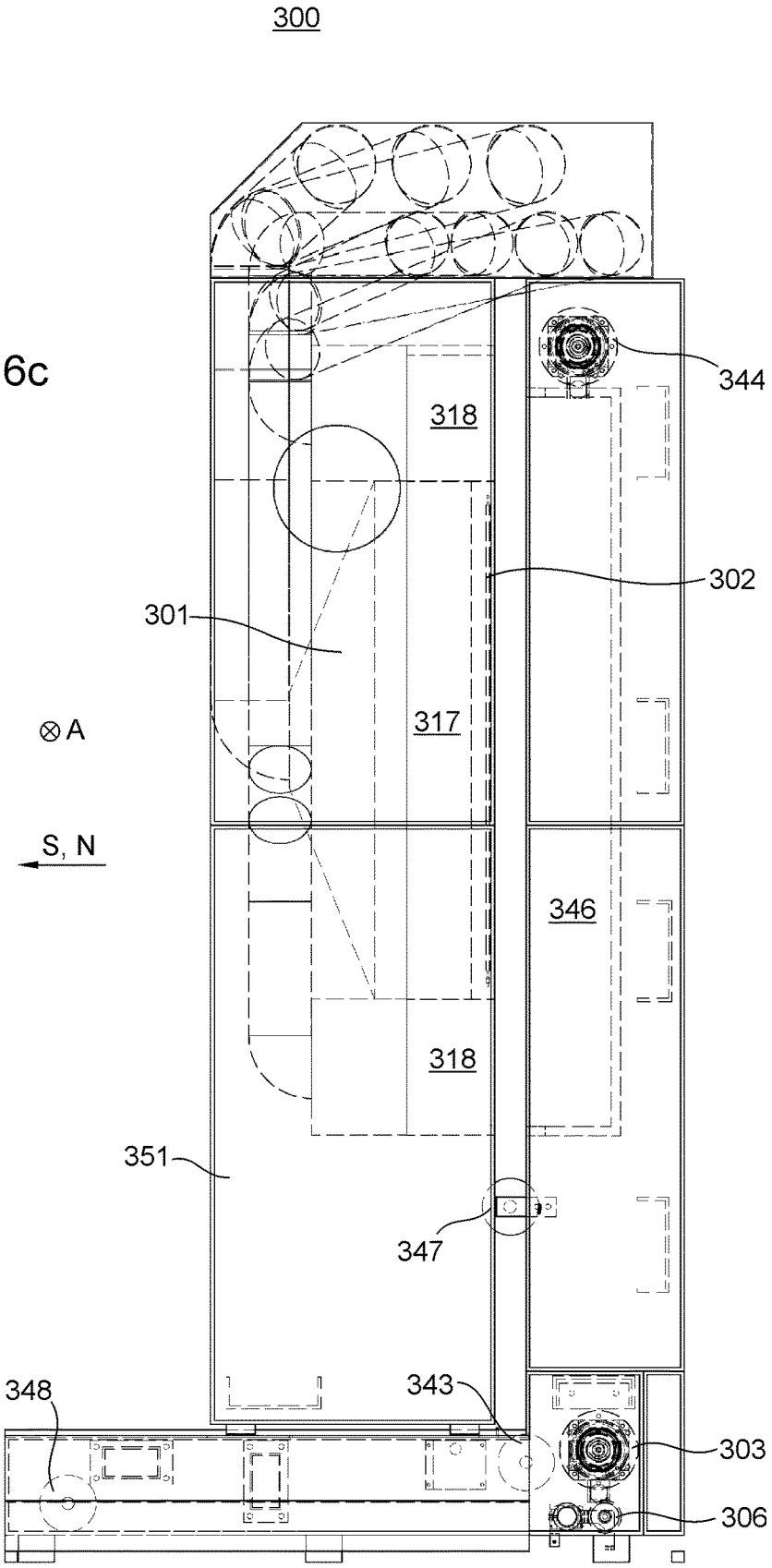
FIG. 6*c* a schematic diagram a schematic diagram of a dryer unit of a printing machine, in which an energy output device is arranged in a deactivated position embodied as a threading position.
Figure 7A:
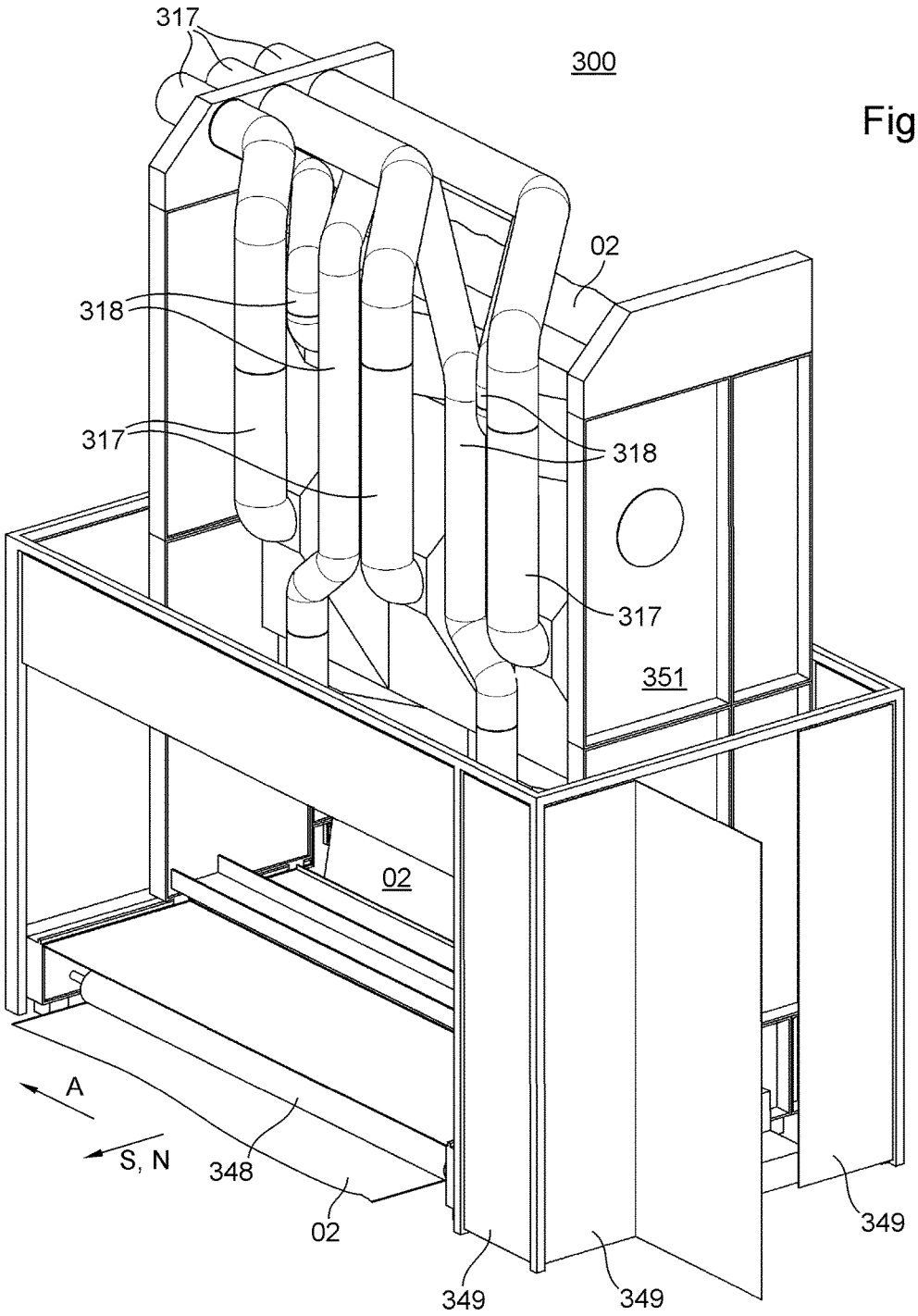
FIG. 7*a* a schematic, perspective diagram of a dryer unit of a printing machine, in which an energy output device is arranged in an active position.
Figure 7B:
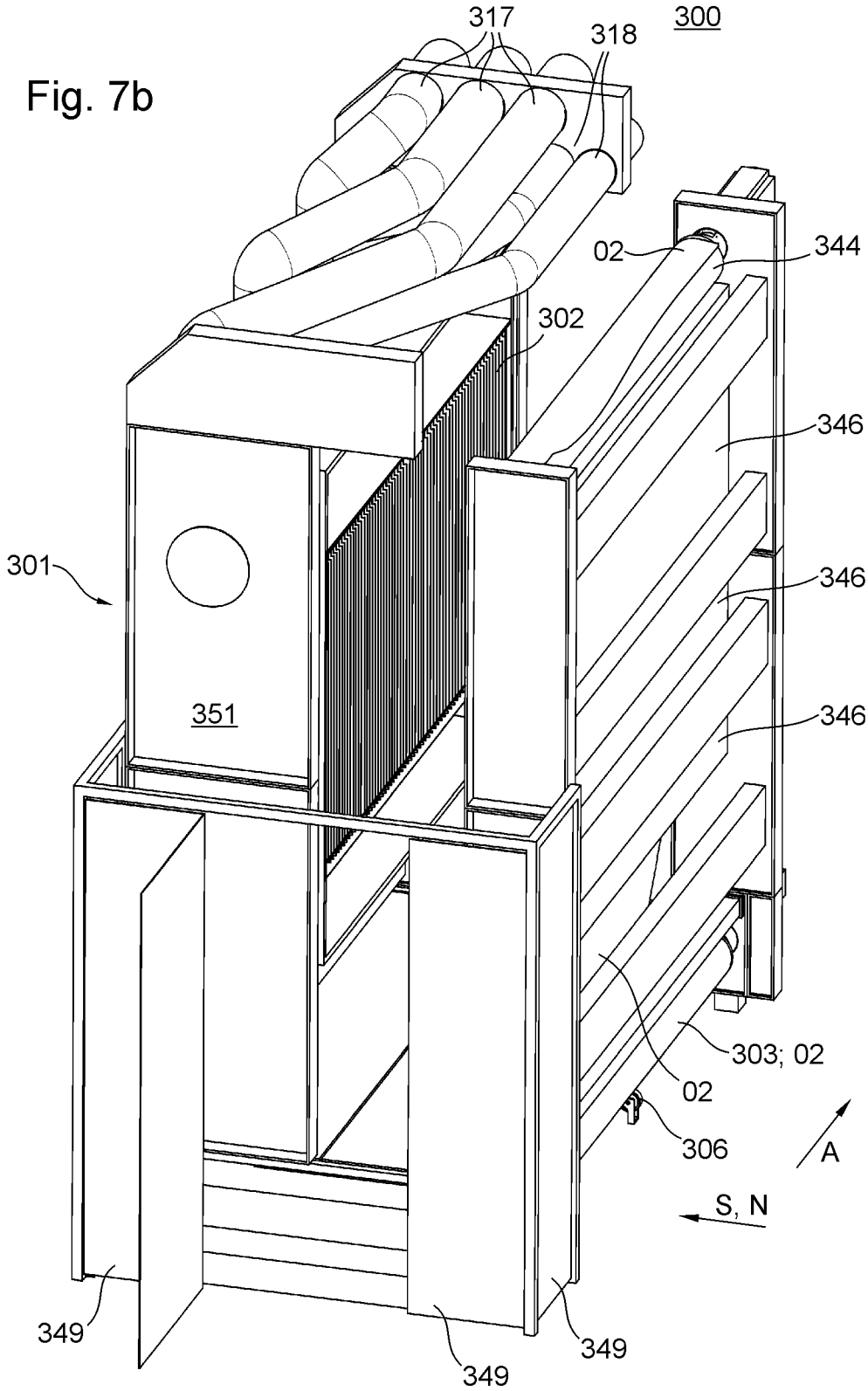
FIG. 7*b* a schematic, perspective diagram of a dryer unit of a printing machine, in which an energy output device is arranged in a deactivated position embodied as a threading position.

The at least one printing assembly 200 preferably has a plurality of support positions 261 along printing section 226 of the transport path provided for printing substrate 02. Support positions 261 are preferably characterized by the fact that the provided transport path is influenced, for example changed, with respect to its transport direction at support positions 261. Said support positions 261 are preferably defined by respective guide elements 241. Guide elements 241 are preferably a component of printing substrate guiding unit 249. Guide elements 241 are preferably those devices that bound and deflect the transport path provided for printing substrate 02 and, in particular if printing substrate 02 is present, are preferably at least partially in contact with printing substrate 02. Possible guide elements 241 include corotating and/or positively driven cylinders and/or rollers and/or belt conveyor devices, however guide elements 241 are preferably configured as integral or multi-part stationary guide elements 241. A deflection angle 227 of a guide element 241 is preferably an angle between a first local transport direction T1 and a second local transport direction T2, the first local transport direction T1 being a direction T1 of the transport path provided for printing substrate 02 in a region in which the provided transport path is approaching or is intended to approach guide element 241, and the second local transport direction T2 being a direction T2 of the transport path provided for printing substrate 02 in a region in which the provided transport path moves away from or is intended to move away from guide element 241. (This is also schematically illustrated by way of example in FIG. 2.) In particular, guide elements 241 are components of the conveying line. At least the guide elements 241 arranged in the region of printing section 226 of the transport path provided for printing substrate 02 are components, in particular, of printing line 224.

Preferably, printing assembly 200 is alternatively or additionally characterized in that the guide elements 241 that together define said transport path in the region of the printing section are stationary guide elements 241 with respect to movements in axial direction A. The at least two guide elements 241 that together define the provided transport path preferably each have an uninterrupted guide surface in the axial direction A over at least 25%, preferably at least 50%, more preferably at least 80% and even more preferably at least 100% of the working width of printing assembly 200. Preferably, the at least one guide element 241 extends in the transverse direction A over the entire working width of printing machine 01. A cross-section of the at least one guide element 241 is preferably an intersection of the at least one guide element with a plane, the surface normal of which is oriented parallel to the transverse direction A. Preferably, the entire cross-section of the at least one guide element 241 is the same as viewed over the working width of printing machine 01, in particular independently of the position of the cross-section within the working region of the at least one first printing assembly 200 and/or independently of the position of the cross-section with respect to transverse direction A.

Relatively flat guide elements 241 are conceivable, for example in the form of slightly bent plates. Preferably, however, the guide elements have a substantially cylindrical shell-shaped surface 228. The cross-section of the at least one guide element 241 preferably has at least one curved outer margin, in particular with a finite radius of curvature that is not equal to zero. This radius of curvature, and thus the radius of guide elements 241, is preferably greater than 5 mm, more preferably greater than 10 mm and even more preferably greater than 13 mm. This radius of curvature, and thus the radius of the guide elements 241, is preferably less than 50 mm, more preferably less than 30 mm and even more preferably less than 18 mm. This curved outer margin preferably lies at least in a region of the cross-section that faces the transport region provided for the printing substrate 02. The curvature is convex, in particular. More preferably, the entire outer margin of said cross-section is curved. Even more preferably, the margin of said cross-section is substantially circular.

The at least one guide element 241 preferably has an outer surface 228 in the shape of a cylindrical shell, at least in the region of the working width of printing machine 01 and/or the working width of the at least one first printing assembly 200, more preferably over the entire extension of the working width of printing machine 01 and even more preferably over the entire extension of the at least one guide element in transverse direction A. Preferably, a plurality of the guide elements 241, more preferably all of the guide elements 241 within printing line 224 of the at least one first printing assembly 200, are identical in construction. Preferably, a plurality of such guide elements 241, in particular at least three, more preferably at least five and even more preferably at least fourteen, for example twenty-eight, are arranged in succession with respect to the transport path provided for printing substrate 02. Printing line 224 preferably has a plurality of such guide elements 241 arranged in succession. The relative arrangement of guide elements 241 of printing line 224 defines a deflection angle 227 for each guide element 241. The deflection angles of guide elements 241 of printing line 224 are preferably substantially equal and deviate from those of the remaining guide elements 241 of printing line 224 the most in the region of a first and/or a last guide element 241 of printing line 224.

When reference is made in the foregoing and/or in the following to guide elements 241, preferably at least, and more preferably, only those guide elements 241 of printing line 224 are meant. Deflection angle 227 of the at least one guide element 241 and more preferably of a plurality of and even more preferably of all of guide elements 241 is preferably at least 0.5° (zero point five degrees), more preferably at least 1° (one degree), and even more preferably at least 1.5° (one point five degrees). Deflection angle 227 of the at least one guide element 241 and more preferably of a plurality of and even more preferably of all of guide elements 241 is preferably at most 10° (10 degrees), more preferably at most 5° (five degrees) and even more preferably at most 2.5° (two point five degrees). Guide elements 241 of printing line 224 are preferably arranged along printing line 224 in the form of an arc, in particular a circular arc.

At least one support element 273; 274 is preferably provided. The at least one support element 273; 274 preferably serves as a supporting device for the at least one guide element 241, more preferably for a plurality of guide elements 241 of printing line 224, and even more preferably for all of guide elements 241 of printing line 224. The at least one support element 273 is configured, for example, as at least one lateral support element 273. The at least one support element 273; 274 is preferably configured as at least one support frame 276 or as part of at least one support frame 276 which has at least two lateral support elements 273, for example, on which, in particular, a plurality of guide elements 241 are mounted, more preferably directly and/or via holding devices. The at least two lateral support elements 273 are preferably embodied, in particular, as part of at least one support frame 276, and the at least one support frame 276 has at least one cross-member 277 that is different from guide elements 241 and extends at least in transverse direction A to ensure the constant relative positioning of lateral support elements 273. For example, the at least one support frame 276 has at least two cross-members 277 that are different from guide elements 241 and that extend at least in transverse direction A to ensure the constant relative positioning of lateral support elements 273. Constant relative positioning in this context preferably refers to the exclusion of any relative movement.

In principle, this function can be performed by the guide elements 241 themselves, in which case it should be noted that when all the guide elements 241 are released from support elements 273; 274, the lateral support elements 273 are no longer fixed relative to one another. For reasons of stability, the provision of at least one cross-member 277 is preferred. The at least one lateral support element 273 preferably has at least one bearing region per guide element 241, on which the respective guide element 241 rests on the lateral support element 273 or is at least in contact with the lateral support element 273. At least one inner support element 274 is preferably provided. The at least one inner guide elements 241 is a component of the at least one support frame 276, for example. The at least one inner support element 274 preferably serves at least to protect one or more, or preferably all of the guide elements 241 from undesirable sagging or at least from sagging to an undesirable degree.

One print head row 222 is preferably assigned to each guide element 241. Alternatively, a plurality of print head rows 222 could also be assigned to each guide element 241, for example if the guide elements 241 were designed as flat guide elements rather than as rods. Preferably, one guide element 241 is assigned to each print head row 222. The shortest distance between a respective nozzle of a respective print head 221 arranged in its printing position on one side and the transport path provided for the printing substrate 02 or the closest guide element 241 arranged in its working position on the other side is preferably at least 0.1 mm, more preferably at least 0.5 mm and even more preferably at least 1.0 mm and is preferably no more than 5 mm, more preferably no more than 3.0 mm and even more preferably no more than 2.0 mm. The shortest distance between a respective nozzle of a respective print head 221 arranged in its printing position on one side and the printing substrate 02 on the other side is preferably at least 0.1 mm, more preferably at least 0.5 mm and even more preferably at least 1.0 mm and is preferably no more than 5 mm, more preferably no more than 3.0 mm and even more preferably no more than 2.0 mm. These distances are correlated over the thickness of printing substrate 02.

At least one shielding device 292 is preferably provided. The at least one shielding device 292 preferably serves to shield parts of the print heads, for example the devices thereof for supplying power to electronic components and/or for supplying printing fluid and/or the mountings thereof and/or parts of nozzle bars 231, from the transport path provided for printing substrate 02, and in particular the printing section 226 thereof and/or from a region that includes the nozzles of print heads 221.

At least rotatable first web guiding means 251 is preferably located upstream of the first guide element 241 of printing line 224 with respect to the transport path provided for printing substrate 02. Said at least one first rotatable web guiding means 251 is preferably embodied as a first motorized web guiding means 251 and/or as a first web guiding roller 251, in particular as a first motorized web guiding roller 251. The at least one first web guiding roller 251 has its own drive motor, for example, and/or the at least one first web guiding roller 251 is part of at least one system for regulating the web tension of a web-type printing substrate 02. At least one rotatable second web guiding means 254 is preferably located downstream of the last guide element 241 of printing line 224 with respect to the transport path provided for printing substrate 02. Said at least one second rotatable web guiding means 254 is preferably embodied as a second motorized web guiding means 254 and/or a second web guiding roller 254, in particular a second motorized web guiding roller 254. For example, the at least one second web guiding roller 254 has its own drive motor and/or the at least one second web guiding roller 254 is part of the at least one system for regulating the web tension of the web-type printing substrate 02. Web guiding means 251; 253; 254; 257 and/or web guiding rollers 251; 252; 253; 254; 256; 257 are preferably components of printing substrate guiding unit 249.

Printing section 226 of the transport path provided for printing substrate 02 preferably ascends monotonically. A first guide element 241 of printing line 224 is preferably positioned lowest of all the guide elements 241 in printing line 224. A last guide element 241 in printing line 224 is preferably positioned highest of all the guide elements 241 in printing line 224.

The at least one printing assembly 200 preferably has at least one and more preferably precisely one pivot device 279. The at least one pivot device 279 is preferably assigned to at least one, more preferably to multiple and even more preferably to all the guide elements 241 of printing line 224. Preferably a plurality of guide elements 241 and more preferably all the guide elements 241 of printing line 224 are arranged so as to pivot, in particular each along an individual pivot path and/or each along a pivot path of different length, about at least one common pivot axis 281; 282, in particular by means of the at least one pivot device 279. Said at least one common pivot axis 281; 282 is preferably at least one pivot axis 281; 282 of pivot device 279 of the at least one printing assembly 200. For example, at least one support element 273; 274, in particular at least one lateral support element 273 and/or at least one inner support element 274, together with the guide elements 241 and/or at least one support frame 276 are arranged so as to pivot about the at least one common pivot axis 281; 282, in particular each along a respective pivot path. The at least one support frame 276 is preferably arranged so as to pivot about the at least one common pivot axis 281; 282.

Each guide element 241 that can pivot about the at least one common pivot axis 281; 282 is preferably assigned a working position and a maintenance position. The working position of each guide element 241 is preferably characterized by the fact that during a printing operation, guide element 241 is in its working position and/or by the fact that the shortest distance between the guide element 241 arranged in its working position and the print head 221 closest to said guide element and arranged in its printing position is no more than 5 mm, more preferably no more than 3.0 mm and even more preferably no more than 2.0 mm, and/or by the fact that the transport path provided for the printing substrate 02 during printing operation forms a tangent with the guide element 241 arranged in its working position. The maintenance position of each guide element 241 is preferably characterized in that when the at least one first printing assembly 200 is in a maintenance mode, the guide element 241 is in its maintenance position, and/or in that the shortest distance between the guide element 241 arranged in its maintenance position and the print head 221 that is closest to said guide element and is arranged in its printing position is at least 5 cm, more preferably at least 10 cm and even more preferably at least 20 cm, and/or in that in its maintenance position, the guide element 241 is spaced from the transport path provided for the printing substrate 02 during printing operation.

In a first embodiment of pivot device 279, pivot device 279 has precisely one common pivot axis 281. In this first embodiment of pivot device 279, the at least one support element 273; 274 and in particular the at least one support frame 276 can be pivoted about a single common pivot axis 281, in particular relative to a stand 283 of the at least one first printing assembly 200. In a second embodiment of pivot device 279, pivot device 279 has at least two and preferably precisely two common pivot axes 281; 282 and at least one intermediate link 284. The at least one intermediate link 284 is preferably pivotable about a first common pivot axis 281 relative to stand 283 of the at least one first printing assembly 200.

The at least one pivot device 279 preferably has at least one, in particular, common pivot drive 286. The at least one pivot drive 286 has at least one linear drive 286, for example. The at least one pivot drive 286, in particular linear drive 286, preferably engages with at least one first connecting element on stand 283, for example directly or with at least one additional component therebetween. The at least one pivot drive 286, in particular linear drive 286, preferably engages with at least one second connecting element on at least one support element 273; 274 and/or at least one cross-member 277 and/or the support frame 276.

A main conveying direction B is preferably defined by a rectilinear connection between a first guide element 241 in the printing line 224 with respect to the transport path provided for printing substrate 02 and a last guide element 241 in the printing line 224 with respect to the transport path provided for printing substrate 02. Main conveying direction B is preferably defined by a rectilinear connection between a first guide element 241 with respect to the printing section 226 of the transport path provided for printing substrate 02 and a last guide element 241 with respect to the printing section 226 of the transport path provided for printing substrate 02. Main conveying direction B is oriented from the first guide element 241 in the printing line 224 with respect to the transport path provided for printing substrate 02 toward the last guide element 241 in the printing line 224 with respect to the transport path provided for printing substrate 02. Main conveying direction B is preferably oriented orthogonally to transverse direction A.

Preferably, the alignment of main conveying direction B when guide elements 241 are arranged in their working position and/or when support frame 276 is arranged in its working position is at an angle of at least 10°, more preferably at least 20° and even more preferably at least 30° from the alignment of main conveying direction B when guide elements 241 are arranged in their maintenance position and/or when support frame 276 is arranged in its maintenance position.

Preferably, when guide elements 241 are arranged in their working position and/or when support frame 276 is arranged in its working position, main conveying direction B has at least one vertically upward-pointing component and at least one horizontal component. When guide elements 241 are arranged in their working position and/or when support frame 276 is arranged in its working position, main conveying direction B is preferably aligned at an angle of at least 10°, more preferably at least 20° and even more preferably at least 30° in relation to a horizontal plane. When guide elements 241 are arranged in their working position and/or when support frame 276 is arranged in its working position, main conveying direction B is preferably aligned at an angle of no more than 70°, more preferably no more than 55° and even more preferably no more than 40° in relation to a horizontal plane. In an alternative embodiment, main conveying direction B would extend substantially horizontally, that is to say at an angle of no more than 5° in relation to a horizontal plane.

When guide elements 241 are arranged in their maintenance position and/or when support frame 276 is arranged in its maintenance position, main conveying direction B preferably has at least one vertically upward-pointing component and more preferably has exclusively a vertically upward-pointing component. When guide elements 241 are arranged in their maintenance position and/or when support frame 276 is arranged in its maintenance position, main conveying direction B is preferably aligned at an angle of no more than 30°, more preferably no more than 20° and even more preferably no more than 10° in relation to a vertical direction.

The joint pivotability of guide elements 241 of printing line 224 and/or the pivotability of the at least one support frame 276 preferably makes it possible for the distance between the nozzles of the print heads and/or the at least one shielding device 292 on one side and the guide elements 241 of the printing line 224 on the other side to be increased. The joint pivotability of guide elements 241 of printing line 224 and/or the pivotability of the at least one support frame 276 thus results in a maintenance space 291 between the nozzles of the print heads 221 and/or the at least one shielding device 292 on one side and the guide elements 241 on the other side. Said maintenance space 291 is accessible to operators, for example. Said maintenance space 291 allows the guide elements 241 of printing line 224 and/or of the at least one shielding device 292 to be maintained and/or cleaned, for example, in particular regardless of the working width of printing machine 01. At least one preferably movable standing support 293, in particular platform 293, is arranged in maintenance space 291, for example.

During a regular printing operation, all print heads 221 are immovably arranged. This serves to ensure a consistently true-to-registration and/or true-to-register alignment of all nozzles. Various situations are conceivable in which a movement of print heads 221 might be necessary. A first such situation is a flying roll change or printing substrate change, or generally a roll change involving a splicing process or a printing substrate change involving a splicing process. At least the print heads 221 and preferably the at least one nozzle bar 231 as a whole can thus be moved in at least one direction relative to the guide plane of the first printing substrate guiding unit 249, in particular set aside from said guide plane, more preferably orthogonally to a surface of the transport path provided for printing substrate 02 that is closest to print head 221. At least one cleaning device is preferably provided, in particular at least one nozzle cleaning device, which has at least one washing nozzle and/or at least one brush and/or at least one squeegee and/or at least one cleaning fleece. Print heads 221 are preferably arranged far enough from guide elements 241 of printing line 224, arranged in particular in their working positions, that the at least one cleaning device, in particular the nozzle cleaning device, fits into a resulting cleaning space 289. Said at least one cleaning device is preferably arranged so as to move in transverse direction A, and more preferably, its dimension in transverse direction A is smaller than the working width of the printing machine. The at least one cleaning device is preferably located outside of the working width of the printing machine with respect to transverse direction A when the print heads 221 assigned to said cleaning device are located in their printing position. Preferably, a separate cleaning device is assigned to each print head row 222 or each double row 223 of print heads 221.

Preferably, along the transport path provided for printing substrate 02, downstream of the at least one first printing assembly 200, at least one first dryer 301 is provided, which includes a region of the transport path provided for printing substrate 02 and embodied as a drying section, which is defined by an active zone of the at least one dryer 301. Once it has passed through the at least one first printing assembly 200, the transport path of printing substrate 02 and particularly of printing substrate web 02 preferably passes through the at least one first dryer 301, where the applied printing fluid is dried. The at least one first dryer 301 is preferably a component of the at least one dryer unit 300.

The at least one dryer unit 300 has at least one first dryer 301, which is preferably embodied as at least one radiation dryer 301 and/or as at least one air flow dryer 301. It is also possible for a plurality of dryers 301 to be arranged one in front of the other along the provided transport path, for example. In the case of a substantially vertical provided transport path, for example, such a plurality of dryers 301 are arranged one above the other in the at least one dryer unit 300. The at least one first dryer 301 has at least one first, preferably controllable and/or adjustable energy output device 302; 317. The at least one first energy output device 302; 317 is embodied, for example, as at least one radiation source 302 and/or at least one air supply line 317. The at least one radiation source 302 is embodied, for example, as an infrared radiation source 302 and/or as a radiation source 302 for ultraviolet light. The at least one radiation source 302 is preferably at least one controllable and/or adjustable radiation source 302. The at least one first energy output device 302; 317 is preferably embodied for the targeted transmission of energy, in particular from the at least one first energy output device 302; 317 to a printing substrate 02 that is and/or can be located in an active zone of the first energy output device 302; 317 and is preferably at least partially furnished with printing fluid. The at least one first energy output device 302; 317 is arranged so as to move, in particular relative to the transport path provided for transporting web-type printing substrate 02. The active zone of the at least one first energy output device 302; 317 preferably intersects the transport path provided for the transport of web-type printing substrate 02.

The at least one first energy output device 302; 317 is arranged so as to move along a positioning path between at least one active position and at least one deactivated position, and more preferably two deactivated positions that are different in particular with respect to a positioning direction S. The positioning path extends in a continuously linear fashion in and/or opposite positioning direction S over at least 75% of its total length, preferably over at least 90% of its total length and more preferably over its entire total length. The total length in this context is the maximum length the positioning path may have between two points. In other words, the at least one first energy output device 302; 317 is arranged so as to move in and/or opposite positioning direction S, along a positioning path that is at least 75% linear, preferably at least 90% linear and more preferably entirely linear, between at least one active position and at least one deactivated position and more preferably two different deactivated positions. Positioning direction S deviates from at least one horizontal direction by no more than 40°, preferably no more than 30°, more preferably no more than 15° and even more preferably no more than 5°. Further, positioning direction S deviates by no more than 40°, preferably no more than 30°, more preferably no more than 15° and even more preferably, no more than 5° from a normal direction N. Said normal direction N is preferably a normal direction N of a mean surface normal of an entire section of the transport path provided for web-type printing substrate 02, said section lying, in particular, in an entire active zone of the at least one first energy output device 302; 317. Normal direction N of the mean surface normal is determined, in particular, as a mean value over all directions of surface normals of tangential planes to all surface elements of the transport path that is provided for printing substrate 02, said surface elements lying in the active zone of the at least one first energy output device 302; 317. If, as is preferred, printing substrate 02 extends substantially vertically through the active zone of the at least one energy output device 302; 317, normal direction N and/or positioning direction S is therefore preferably aligned substantially horizontally.

Printing machine 01 is preferably characterized in that at least one and preferably precisely one preferably continuous threading means, movable along at least one threading path, for threading-in a printing substrate web 02 is and/or can be located, at least intermittently and preferably permanently, at least within the at least one dryer unit 300, and more preferably also within the at least one printing assembly 200, and even more preferably in the further region of printing machine 01. A location within the dryer unit 300 is understood in particular to mean that a projection of the at least one threading means intersects the active zone of the at least one energy output device 302; 317 in or opposite axial direction A or transverse direction A.

At least two deactivated positions of the at least one first energy output device 302; 317 that are different in particular with respect to positioning direction A are preferably provided, in which the at least one first energy output device 302; 317 can be arranged selectively, depending on the operating mode. The at least two provided deactivated positions are preferably provided in addition to the at least one active position. One of the deactivated positions is a threading position, for example, and/or one of the deactivated positions is an access position. The threading position is preferably occupied when a printing substrate 02 will be threaded-in through the at least one dryer unit 300. The access position is preferably occupied when an operator requires access to a side of the at least one energy output device 302; 317 that faces the provided transport path.

The shortest distance between the at least one first energy output device 302; 317 and the transport path provided for printing substrate 02 is greater when the first energy output device 302; 317 is located in the access position than when the first energy output device 302; 317 is located in the threading position, for example. More particularly, the shortest distance between the at least one first energy output device 302; 317 and the transport path provided for printing substrate 02 when the first energy output device 302; 317 is located in the threading position is greater, preferably by at least 5 mm, more preferably by at least 50 mm and even more preferably by at least 90 mm, and independently thereof by no more than 400 mm, for example, than when the first energy output device 302; 317 is located in the active position. Preferably, the shortest distance between the at least one first energy output device 302; 317 and the transport path provided for printing substrate 02 when the first energy output device 302; 317 is located in the access position is greater, preferably by at least 450 mm, more preferably by at least 600 mm and even more preferably by at least 700 mm, than when the first energy output device 302; 317 is located in the active position.

At least one measuring roller 343 and/or at least one first deflecting roller 347, which are preferably wrapped by the transport path provided for the printing substrate 02 and/or by the printing substrate 02, are preferably arranged along the transport path provided for printing substrate 02, downstream of the active zone of the at least one first energy output device 302; 317. Preferably, along the transport path provided for printing substrate 02, upstream of the active zone of the at least one first energy output device 302; 317, at least one first feed roller 344 is provided, to which a dedicated drive motor is assigned and which is preferably wrapped by the transport path provided for printing substrate 02 and/or by the printing substrate 02, and/or along the transport path provided for printing substrate 02, downstream of the active zone of the at least one first energy output device 302; 317 and/or downstream of the at least one measuring roller 343 and/or downstream of the at least one first deflecting roller 347, at least one second feed roller 303 is arranged, which is preferably wrapped by the transport path provided for printing substrate 02 and/or by printing substrate 02. The at least one second feed roller 303 and/or the at least one measuring roller 343 and/or the at least one first deflecting roller 347 is preferably embodied as at least one cooling roller 303.

A plurality of contact pressure rollers 306, for example at least three, more preferably at least five and even more preferably at least nine, are preferably arranged each pressing individually against the at least one second feed roller 303. Each of said contact pressure rollers 306 is arranged on its own lever arm, for example, which is arranged so as to pivot by means of its own force element. Preferably all of such lever arms are arranged so as to pivot about a common axis. Along the transport path provided for printing substrate 02, downstream of the at least one feed roller 303, at least one second deflecting roller 348 is preferably arranged, which is preferably wrapped by the transport path provided for printing substrate 02 and/or by printing substrate 02. The at least one second deflecting roller 348 is identical to the at least one web guiding roller 257, for example.

At least one positioning drive is preferably provided, by means of which the at least one energy output device 302; 317 can be moved along the positioning path. The at least one positioning drive is embodied, for example, as at least one hydraulic drive and/or at least one pneumatic drive. Preferably, the at least one positioning drive is embodied as at least one electric drive and/or more preferably has at least one threaded spindle and at least one threaded nut that cooperates with said spindle.

Preferably, the printing machine 01 having the at least one first printing assembly 200 is characterized in that the at least one dryer unit 300 having the at least one first dryer 301 is located downstream of the at least one first printing assembly 200 along the transport path provided for printing substrate 02, and has a region of the transport path provided for printing substrate 02, embodied in particular as a drying section, which is defined by the active zone of the at least one first dryer 301. Preferably over at least half, and more preferably at least 75% of the entire drying section of the transport path provided for printing substrate 02, a transport direction provided for printing substrate 02 has at least one vertical, preferably downward-pointing component, which is greater than any horizontal component of said transport direction that may be present.

The axial direction A or transverse direction A is preferably defined by a rotational axis of the at least one first feed roller 344 and/or by a rotational axis of the at least one second feed roller 303, in particular as a direction parallel to said rotational axis. Positioning direction S of the at least one energy output device 302; 317 is preferably linear. Positioning direction S of the at least one energy output device 302; 317 deviates from axial direction A or transverse direction A by at least 50°, preferably at least 60°, more preferably at least 75° and even more preferably at least 85°. At the same time, positioning direction S of the at least one energy output device 302; 317 preferably deviates from at least one horizontal direction by no more than 40°, preferably no more than 30°, more preferably no more than 15° and even more preferably, no more than 5°.

Solvent and/or moisture from printing substrate web 02 and/or from the printing fluid located thereon is preferably removed by means of the radiation emitted by the at least one energy output device 302; 317 and is absorbed by the ambient air in the interior of the at least one first dryer 301. The transport path of printing substrate web 02 extends through said interior of the at least one first dryer 301. At least one ventilation device is preferably located in the region of the at least one energy output device 302; 317.

The ventilation device preferably has at least one air supply line 317 and at least one air removal line 318. Thus, in addition to being embodied as a radiation dryer 301, the at least one first dryer 301 is likewise embodied as an air flow dryer 301. The at least one air supply line 317 is preferably located between at least two air removal lines 318 along the transport path provided for printing substrate 02. The at least one air supply line 317 has tubular sections, for example, and/or the at least one air supply line 317 ends in a funnel-shaped end region that has a substantially larger cross-sectional area than other sections of the at least one air supply line 317. The at least one air removal line 318 has tubular sections, for example, and/or the at least one air removal line 318 begins in a funnel-shaped starting area that has a substantially larger cross-sectional area than other sections of the at least one air removal line 318.

Preferably, the at least one air supply line 317 is at least one energy output device 317, and at least one radiation source 302 is likewise at least one energy output device 302. In that case, the at least one dryer 301 then has at least two energy output devices 302; 317. The at least one air supply line 317 and/or the at least one air removal line 318 each preferably have at least one flexible region, with which they are connected to a stationary air transport device. At least one radiation shield 346 and/or at least one reflector 346 is preferably located on a side of the transport path provided for printing substrate 02 that faces away from the at least one energy output device 302; 317. At least one heat exchanger is preferably provided, by means of which air flowing through the at least one air removal line 318 can deliver energy to the air flowing through the at least one air supply line 317.

At least one barrier device 349 is preferably provided, by means of which a safety zone is and/or can be isolated from a surrounding area. The safety zone is preferably a zone that comprises at least every volume that can be occupied by the at least one energy output device 302 and optionally also by at least one dryer stand 351 that supports the at least one energy output device 302 during its movements along the positioning path. More preferably, the safety zone also encompasses a larger space. The safety zone can preferably be entered from the surrounding area via at least one closeable opening in barrier device 349. Said at least one opening can preferably be closed by means of a closing device 352, for example at least one door 352. The at least one energy output device 302 is preferably able to move, in particular, out of its active position and/or its access position and/or its threading position only when the at least one closing device 352 is closed and/or when a signal generator located outside of the safety zone is actuated. The at least one closing device 352 is preferably opened only when the at least one energy output device is arranged in its access position.

Printing machine 01 can be used in particular for carrying out a preferred method for operating a printing machine 01. This is a method for operating printing machine 01 in which printing machine 01 has the at least one first printing assembly 200 and the at least one dryer unit 300, and in which the at least one dryer unit 300 has the at least one first dryer 301 with at least the first energy output device 302; 317. In a first deactivation process, the at least one energy output device 302; 317 is preferably moved, in particular by means of the at least one positioning drive, at least 5 mm, preferably at least 50 mm and more preferably at least 90 mm, and independently thereof, for example, no more than 400 mm in the positioning direction S along a linear positioning path from the active position to the threading position, and is halted there. In a subsequent threading process, at least one web-type printing substrate 02 is preferably drawn along the transport path provided for printing substrate 02 through the active zone of the at least one energy output device 302; 317 by means of at least one threading means, which is different in particular from any printing substrate 02. More preferably, in a subsequent first resetting process, the at least one first energy output device 302; 317 is moved, in particular by means of the at least one positioning drive, back from the threading position, opposite positioning direction S, along the same linear positioning path to the active position, and is halted there.

Between the first deactivation process and a second deactivation process, in at least one drying process, energy is preferably delivered in the active zone of the first energy output device 302; 317 by the at least one first energy output device 302; 317 to the web-type printing substrate 02 that was previously threaded in. Further preferably, the web-type printing substrate 02 that was previously threaded-in has already been provided at least partially with at least one printing fluid in the at least one printing assembly 200.

In a second, in particular subsequent deactivation process, the at least one first energy output device 302; 317 is moved, in particular by means of the at least one positioning drive, preferably at least 450 mm, more preferably at least 600 mm and even more preferably at least 700 mm, in particular in the same positioning direction S along the same linear positioning path, in particular, from the active position to an access position that is different from the threading position, and is halted there. In a subsequent first maintenance process, at least one maintenance task is preferably performed on the at least one first energy output device 302; 317, for example at least one current-carrying component is replaced and/or one component is cleaned. Further preferably, in a subsequent second resetting process, the at least one first energy output device 302; 317 is moved back, in particular by means of the at least one positioning drive, opposite positioning direction S along the same linear positioning path from the access position to the active position, and is halted there.

The method is preferably characterized in that the at least one threading means is connected in a connecting procedure to the at least one printing substrate web 02 by means of at least one connecting element. The at least one connecting element preferably passes through a printing position of the at least one print head 221 while the latter is set aside from the provided transport path and/or is arranged in at least one idle position, and/or the at least one connecting element passes through at least one target region of at least one nozzle of the at least one print head 221 during the threading process, and/or no component of the at last one threading means passes through a target region of a nozzle of the at least one print head 221 during the threading process. Preferably, the at least one connecting element passes through an active zone of the at least one energy output device 302; 317 of the at least one first dryer 301 while the energy output device is in a deactivated position embodied as a threading position. During the threading process, preferably no component of the at least one threading means passes through the active zone of the at least one energy output device 302; 317. Preferably, only at least one threading means is used, said threading means being arranged on only one side of the provided transport path for printing substrate 02 with respect to the axial direction, and/or the threading path of said threading means extending on only one side of the provided transport path for printing substrate 02.

After printing substrate web 02 has passed through the at least one first printing assembly 200, printing substrate web 02 is transported further along its transport path and is preferably fed to the at least one first dryer 301 of the at least one dryer unit 300. Preferably, a transport path for printing substrate 02 comprising one or more guiding and/or conveying means is formed downstream of the last printing position 201 such that the first side of printing substrate web 02, which is imprinted in the at least one first printing assembly 200, does not come into physical contact with any component of web-fed printing machine 01, in particular with any guiding and/or conveying means, between the time said printing substrate web passes through the last printing position 201 and the time it enters the active zone of the at least one energy output device 302; 317 of the at least one first dryer 301. The second side of printing substrate web 02, which is, in particular, not imprinted by the first printing assembly 200, is preferably in contact with at least one web guiding means 257, for example at least one web guiding roller 254; 256; 257 and/or the first feed roller 344, between the time said printing substrate web passes through the last printing position 201 and the time it enters the active zone of the at least one energy output device 302; 317 of the at least one first dryer 301.

The transport direction provided for printing substrate 02 preferably has at least one vertical, preferably downward-pointing component, over at least half and more preferably at least 75% of the entire drying section, that is greater than any horizontal component of said transport direction that may be present. For this purpose, a motorized web guiding roller 254 or feed roller 344 is preferably provided, which is wrapped by printing substrate 02 and/or by the provided transport path at a wrap angle of preferably at least 45°, more preferably at least 60° and even more preferably at least 75°. Said at least one motorized web guiding roller 254 or feed roller 344 is preferably located along printing substrate 02 and/or along the transport path provided for printing substrate 02, downstream of the last guide elements of printing line 224 and upstream of the active zone of the at least one dryer 301.

The at least one first dryer 301 preferably has at least one radiation source 302, which is preferably embodied as a radiation source 302 for microwaves and/or for radiation in the visible range and/or in the ultraviolet range of the electromagnetic spectrum and/or more preferably is embodied as infrared radiation source 302. The at least one first dryer 301 is preferably embodied as an infrared radiation dryer 301. A radiation source 302, preferably infrared radiation source 302, is a device by means of which electrical energy is and/or can be selectively converted into radiation, preferably infrared radiation, and is and/or can be directed toward printing substrate web 02. The at least one radiation source 302 forms the at least one energy output device 302. The at least one radiation source 302 preferably has a defined active zone. The active zone of a radiation source 302 in each case is the area that contains all points that can be connected directly to the radiation source 302, in particular in a straight line without interruption, or via reflectors that are provided specifically for this purpose. The active zone of the at least one first dryer 301 is preferably composed of the active zones of all the radiation sources 302 of the at least one first dryer 301 and/or of the active zones of all air supply lines 317 of the at least one first dryer 301. The active zone of the at least one first dryer 301 preferably points from the at least one radiation source 302 to a part of the transport path of printing substrate web 02 that is closest to the at least one radiation source 302.

Air is preferably introduced into the interior of the at least one first dryer 301 through at least one ventilation opening of the at least one air supply line 317. In the interior of first dryer 301, water and/or solvent from the printing inks, to be removed from printing substrate web 02, are then removed by means of the infrared radiation, for example, and absorbed by the introduced air. This air is then removed from the at least one first dryer 301 via at least one venting opening and/or at least an air removal line 318.

At least one first cooling device is preferably located downstream of the active zone of the at least one radiation source 302 of the at least one first dryer 301 in the direction of transport of printing substrate web 02. The at least one first cooling device preferably has the at least one first cooling roller 303 and preferably a first pressing cooling roller that can be and/or is thrown onto the at least one first cooling roller 303, and/or preferably also has the at least one and in particular the plurality of contact pressure rollers 306 that can be and/or are thrown onto the at least one first cooling roller 303.

Preferably, at least parts of the at least one threading path, and preferably the entire threading path are spaced by a distance of at least 2 cm, more preferably at least 4 cm, even more preferably at least 6 cm and more preferably still, at least 8 cm with respect to axial direction A or transverse direction A from each target region of each nozzle of each print head 221 of said at least one printing assembly. Preferably, at least parts of the threading means and more preferably the entire threading means are spaced by a distance of at least 2 cm, more preferably at least 4 cm, even more preferably at least 6 cm and more preferably still, at least 8 cm with respect to axial direction A or transverse direction A from each target region of each nozzle of each print head 221 of said at least one printing assembly 200. In particular, the at least one threading path and/or the at least one threading means is preferably arranged outside of the working width of printing machine 01 with respect to axial direction A. The threading path in the region of printing section 226 of the transport path provided for printing substrate 02 is preferably curved in precisely one direction.

The threading means is preferably different from any printing substrate 02. The at least one threading means is embodied, for example, as at least one continuous threading means, for example as at least one continuous threading belt. Alternatively, the at least one threading means is embodied as at least one finite threading means, for example as a finite threading belt and/or as a finite threading chain. At least one threading drive is preferably provided, which can be used for moving the at least one threading means along the at least one threading path. In the case of a continuous threading means, it is sufficient for precisely one such threading drive to be provided, for example. Alternatively, the at least one threading means may be embodied as finite. In that case, at least one threading storage device is preferably provided, in which the at least one threading means can be arranged at least intermittently, in particular as long as it is not being used for threading-in a printing substrate web 02. In an alternative embodiment, the at least one threading means is embodied as at least one finite threading chain. In the preferred case of the at least one continuous threading means, the at least one threading means for threading-in a printing substrate web 02 along the provided transport path of printing substrate web 02 is preferably arranged, in particular permanently, along its at least one threading path within printing machine 01.

At least one threading guide element is preferably provided, by means of which at least one threading path of the at least one threading means can be and/or is defined. The at least one threading guide element is embodied, for example, as at least one deflecting roller. Alternatively, the at least one threading guide element is embodied as at least one chain guide. Preferably, the at least one threading guide element is embodied as at least one rotatable threading guide element, for example as at least one deflecting roller. A chain guide, in particular, can also have shunts for achieving different threading paths.

The at least one threading means for threading-in a printing substrate web 02 is preferably arranged along the provided transport path for printing substrate web 02, in particular permanently along its at least one threading path within printing machine 01. Preferably, the at least one threading means has at least two and more preferably at least five designated connecting points, at which at least one printing substrate web 02 can be connected, directly and/or via at least one connecting element, to the at least one threading means. Printing machine 01 is preferably characterized in that the at least two connecting points are spaced from one another in the axial direction A or transverse direction A by no more than 10 cm, more preferably no more than 5 cm, even more preferably no more than 2 cm and more preferably still, by no distance at all, and/or in that the at least two connecting points are spaced from one another along the at least one threading path.

Before printing substrate web 02 is threaded in through the at least one printing assembly 200, at least one print head 221 of the at least one printing assembly 200, embodied as an inkjet print head 221, is preferably set aside from the provided transport path of the at least one printing substrate web 02. Subsequently, in a sub-process of a threading process, at least one threading means is preferably moved along a threading path through the at least one printing assembly 200, thereby drawing the at least one printing substrate web 02 along the transport path provided for the at least one printing substrate web 02. The threading path and the transport path are preferably spaced from one another as viewed in an axial direction A or transverse direction A.

Along the transport path of printing substrate web 02, downstream of an outfeed nip and/or downstream of a rewetting unit, at least one post-processing device is arranged, which is preferably embodied as a single-stage or multi-stage folding apparatus, and/or has a sheet cutter and/or a planar delivery unit, or is embodied as a winding apparatus. In and/or by means of said post-processing device, printing substrate web 02 is preferably folded and/or cut and/or stitched and/or sorted and/or inserted and/or transported and/or wound.

The working width of printing machine 01 and/or of the at least one first printing assembly 200 and/or the width of a printing substrate 02 to be processed is at least 1500 mm, for example, preferably at least 2000 mm and more preferably at least 2500 mm. However, even greater working widths and/or web widths can be enabled by means of the provided guide elements 241, in particular in conjunction with the provided inner support elements 274, and/or by means of the positioning direction S of the at least one energy output device 302.

While preferred embodiments of a printing machine having at least one printing assembly and at least one dryer unit and a method for operating such a printing machine have been set forth fully and completely hereinabove, it will be apparent to one of skill in the art that various changes could be made without departing from the true spirit and scope of the subject invention which is accordingly to be limited only by the appended claims.

The invention claimed is:

1. A printing machine comprising:

at least a first printing assembly and at least a first dryer unit, the at least first printing assembly having at least a first inkjet print head and the at least first dryer unit having at least one first dryer;

at least one first energy output device in the at least first dryer unit, the at least first energy output device being arranged to move along a positioning path between at least an active position and at least a first deactivated position, the positioning path extending in a continuously linear fashion one of in and opposite a positioning direction over at least 75% of a total length of the positioning path, the positioning direction deviating not more than 40° from at least one horizontal direction;

wherein the positioning direction deviates not more than 40° from a normal direction of a mean surface normal of an entire section of a transport path provided for a web-type printing substrate, the entire section lying in an active zone of the at least one first energy output device, and further wherein the normal direction of the mean surface normal is determined as a mean value over all directions of surface normals of tangential planes on all surface elements of the transport path provided for the printing substrate that lie in the active zone of the at least one first energy output device.

2. A printing machine comprising:

at least a first printing assembly and at least a first dryer unit, the at least first dryer unit having at least a first dryer;

at least one first energy output device in the at least first dryer unit, the at least one first energy output device being arranged to move along a positioning path between at least an active position and at least a first deactivated position, the positioning path extending in a continuously linear fashion one of in and opposite a positioning direction over at least 75% of a total length of the positioning path, the positioning direction deviating not more than 40° from at least one horizontal direction;

wherein the positioning direction deviates no more than 40° from a normal direction of a mean surface normal of an entire section of a transport path provided for web-type printing substrate, the entire section lying in an active zone of the at least one first energy output device, wherein the normal direction of the mean surface normal is determined as a mean value over all the directions of surface normals of tangential planes on all surface elements of the transport path provided for the printing substrate that lie in the active zone of the at least one first energy output device, wherein at least two guide elements of the printing assembly define a transport path provided for a printing substrate through the printing assembly, wherein, when guide elements are in a working position, a main conveying direction of the at least one printing assembly is situated upstream of the at least one dryer unit;

and further wherein the main conveying direction is defined by a rectilinear connection between a first guide element with respect to a printing section of the transport path provided for printing substrate in the at least one printing assembly situated upstream of the at least one dryer unit and a last guide element, with respect to the printing section of the transport path provided for printing substrate in the at least one printing assembly situated upstream of the at least one dryer unit, and has a component that points upward.

3. The printing machine according to claim 1, further including at least one threading means that is movable along at least one threading path for threading in a printing substrate web one of which is and can be arranged, at least intermittently, at least within the at least one dryer unit.

4. The printing machine according to claim 1, further including at least a second deactivated position of the at least one first energy output device, different from the first deactivated position, one of wherein the at least one first energy output device can be selectively arranged, in one of the first and second deactivated positions depending on an operating mode, and wherein the at least first and second deactivated positions of the at least one first energy output device, which are different in terms of the positioning direction, are provided, in one of which first and second deactivated positions the at least one first energy output device can be selectively arranged, depending on the operating mode.

5. The printing machine according to claim 2, wherein the at least first printing assembly has at least one inkjet print head.

6. The printing machine according to claim 1, one of wherein the at least one dryer is embodied as a radiation dryer, and the at least one first energy output device is embodied as at least one of a controllable and an adjustable radiation source, and one of wherein the at least one dryer is embodied as one of an air flow dryer and the at least one first energy output device is embodied as at least one air supply line.

7. The printing machine according to claim 1, further including at least a first positioning drive, by which at least first positioning drive the at least one energy output device can be moved along the positioning path, and wherein the positioning path extends in a continuously linear fashion one of in and opposite a positioning direction over its entire total length.

8. The printing machine according to claim 1, wherein a transport direction, which is provided for a web-type printing substrate, has a vertical, downward-pointing component in the active zone of the at least one energy output device.

9. The printing machine according to claim 1, wherein a transport path provided for the printing substrate through the printing assembly is defined by at least two guide elements of the printing assembly, wherein, when the at least two guide elements are arranged in their working position, the main conveying direction of the at least one printing assembly situated upstream of the at least one dryer unit, which main conveying direction is defined by a rectilinear connection between a first guide element with respect to a printing section of the transport path provided for printing substrate in the at least one printing assembly situated upstream of the at least one dryer unit and a last guide element with respect to the printing section of the transport path provided for printing substrate in the at least one printing assembly situated upstream of the at least one dryer unit, has a directional component that points upward.

10. The printing machine according to claim 1, wherein the at least one printing assembly has at least two inkjet print heads, each of which defines an application position for printing fluid, and wherein a transport path provided for a printing substrate through the printing assembly is defined by at least two stationary guide elements of the at least one printing assembly, and wherein a printing section of the transport path provided for a printing substrate begins at a first application position in the printing assembly along the transport path and ends at a last application position in the printing assembly along the transport path, and wherein, along the printing section of the transport path, at least five stationary guide elements, that together define the transport path, are arranged one in front of the other.

11. The printing machine according to claim 9, wherein, when the at least two guide elements are arranged in maintenance positions, the main conveying direction is arranged at an angle of no more than 30° in relation to a vertical direction.

12. A method for operating a printing machine including:

providing the printing machine having at least a first printing assembly and at least a first dryer unit;

providing the at least one dryer unit having at least one first dryer with at least one first energy output device;

moving, in a first deactivation process, the at least one first energy output device at least 5 mm along a positioning path in a positioning direction from an active position to a threading position and halting it there;

extending the positioning path in a continuously linear fashion one of in and opposite the positioning direction over at least 75% of its total length;

threading in, during a subsequent threading process, at least one web-type printing substrate, by use at least one threading means along a transport path provided for the printing substrate through an active zone of the at least one energy output device;

moving, in a second deactivation process, the at least one first energy output device at least 450 mm in the positioning direction along the positioning path, which extends in a continuously linear fashion one of in and opposite the positioning direction over at least 75% of its total length, from the active position to an access position that is different from the threading position, and is halted there;

and performing, in a subsequent first maintenance process, at least one maintenance task on the at least one first energy output device.

13. The method according to claim 12, further including one of deviating the positioning direction not more than 40° from at least one horizontal direction and deviating the positioning direction not more than 40° from a normal direction of a mean surface normal of an entire section of the transport path provided for a web-type printing substrate, which entire section lies in an active zone of the at least one first energy output device, and extending the positioning path in a continuously linear fashion one of in and opposite a positioning direction over its entire total length.

14. The method according to claim 12, further including one of that, in a first resetting process that takes place after the threading process, the at least one first energy output device is moved opposite the positioning direction along the same linear positioning path from the threading position back to the active position, and is halted there, and in a second resetting process, that takes place after the first maintenance process, the at least one first energy output device is moved opposite the positioning direction along the same linear positioning path, from the access position back to the active position, and is halted there, and between the first deactivation process and the second deactivation process, in at least one drying process, energy is delivered in the active zone of the first energy output device by the at least one first energy output device to the web-type printing substrate that was previously threaded-in.

15. The method according to claim 12, further including providing the previously threaded-in web-type printing substrate at least partially with at least one printing fluid in the at least one printing assembly.

* * * * *